US010465349B2

(12) United States Patent
Powell

(10) Patent No.: US 10,465,349 B2
(45) Date of Patent: Nov. 5, 2019

(54) ILLUMINATED BARRIER APPARATUS

(71) Applicant: Care Barrier Limited, Pueblo, CO (US)

(72) Inventor: Jay Harlan Powell, Pueblo, CO (US)

( * ) Notice: Subject to any disclaimer, the term of this patent is extended or adjusted under 35 U.S.C. 154(b) by 0 days.

(21) Appl. No.: 16/215,476

(22) Filed: Dec. 10, 2018

(65) Prior Publication Data

US 2019/0177936 A1 Jun. 13, 2019

Related U.S. Application Data

(60) Provisional application No. 62/597,784, filed on Dec. 12, 2017, provisional application No. 62/650,124, filed on Mar. 29, 2018, provisional application No. 62/765,215, filed on Aug. 20, 2018.

(51) Int. Cl.

| | |
|---|---|
| ***E01F 15/08*** | (2006.01) |
| ***E04H 15/10*** | (2006.01) |
| ***E04H 15/02*** | (2006.01) |
| ***E04H 15/44*** | (2006.01) |
| ***F21S 6/00*** | (2006.01) |
| ***F21V 23/00*** | (2015.01) |
| ***F21V 23/02*** | (2006.01) |
| ***E04H 15/54*** | (2006.01) |
| ***E01F 13/02*** | (2006.01) |
| *F21W 111/02* | (2006.01) |

(52) U.S. Cl.

CPC ..... *E01F 15/08* (2013.01); *E01F 13/024* (2013.01); *E01F 13/028* (2013.01); *E04H 15/02* (2013.01); *E04H 15/10* (2013.01); *E04H 15/44* (2013.01); *E04H 15/54* (2013.01); *F21S 6/004* (2013.01); *F21V 23/001* (2013.01); *F21V 23/023* (2013.01); *E01F 15/086* (2013.01); *F21W 2111/02* (2013.01)

(58) Field of Classification Search

CPC ..... E01F 13/024; E01F 13/028; E01F 15/02; E01F 15/08; E01F 15/086

USPC ..... 404/6

See application file for complete search history.

(56) References Cited

U.S. PATENT DOCUMENTS

| | | | | |
|---|---|---|---|---|
| 4,516,109 A | | 5/1985 | Thurston | |
| 5,595,230 A | * | 1/1997 | Guerra | E01F 7/00 160/135 |
| 5,902,969 A | * | 5/1999 | Helpinen | E01F 8/007 181/210 |
| 6,179,516 B1 | * | 1/2001 | Ivey | E01F 15/146 256/13.1 |
| 6,692,182 B1 | | 2/2004 | Fenimore | |

(Continued)

FOREIGN PATENT DOCUMENTS

| | | |
|---|---|---|
| EP | 0856609 A1 | 6/1996 |
| EP | 1619324 A1 | 1/2006 |

(Continued)

*Primary Examiner* — Gary S Hartmann

(74) *Attorney, Agent, or Firm* — Law Offices of Howard L. Hoffenberg, Esq.; Howard Leslie Hoffenberg

(57) ABSTRACT

An illuminated barrier apparatus used for crowd and vehicle control which offers guidance and notices for and to pedestrians and motorists and affords additional light to an area. The illuminated barrier apparatus has a base, cross-sectional members, a tent-like covering, a lighting system and adaptions to be an illuminated enclosure retrofit embodiment for a Jersey Barrier or adaptions to be a standalone illuminated barrier embodiment.

25 Claims, 19 Drawing Sheets

(56) References Cited

U.S. PATENT DOCUMENTS

| | | | | |
|---|---|---|---|---|
| 7,257,875 | B2 * | 8/2007 | Masinelli | E01F 15/0423 256/13.1 |
| 7,321,954 | B2 | 1/2008 | Dieffenderfer et al. | |
| 7,832,957 | B2 * | 11/2010 | Gelfand | E01F 13/024 256/1 |
| 8,622,648 | B2 | 1/2014 | Mustafa | |
| D756,256 | S | 5/2016 | Hinebaugh | |
| 9,334,686 | B2 | 5/2016 | Oakes | |
| 9,489,941 | B2 | 11/2016 | Huggins | |
| 10,000,924 | B2 | 6/2018 | Lasry | |
| 2004/0197140 | A1 | 10/2004 | Maleska | |
| 2009/0250675 | A1 * | 10/2009 | Cashin | E01F 13/12 256/13.1 |
| 2011/0162280 | A1 | 7/2011 | Yu | |
| 2012/0121336 | A1 * | 5/2012 | Arciszewski | E01F 13/12 405/114 |
| 2013/0228730 | A1 * | 9/2013 | Grosjean | E01F 15/146 256/13.1 |
| 2018/0142495 | A1 * | 5/2018 | Mohn | E01F 7/00 |

FOREIGN PATENT DOCUMENTS

| | | | |
|---|---|---|---|
| GB | 2527583 | A | 12/2015 |
| TW | 269531 | U | 7/2005 |
| WO | 0146525 | A1 | 6/2001 |

* cited by examiner

ILLUMINATED BARRIER APPARATUS

CROSS-REFERENCE TO RELATED APPLICATIONS

This application claims priority from U.S. Provisional Application Ser. No. 62/597,784 which was filed on Dec. 12, 2017. The entirety of U.S. Provisional Application Ser. No. 62/597,784 which was filed on Dec. 12, 2017 is incorporated herein by reference.

This application also claims priority from U.S. Provisional Application Ser. No. 62/650,124 which was filed on Mar. 29, 2018. The entirety of U.S. Provisional Application Ser. No. 62/650,124 which was filed on Mar. 29, 2018 is incorporated herein by reference.

This application also claims priority from U.S. Provisional Application Ser. No. 62/765,215 which was filed on Aug. 20, 2018. The entirety of U.S. Provisional Application Ser. No. 62/765,215 which was filed on Aug. 20, 2018 is incorporated herein by reference.

BACKGROUND OF THE INVENTION

1. Field of the Invention

This invention pertains generally to barriers and more particularly to pedestrian and vehicle barriers.

2. Related Art

The Merriam-Webster online dictionary defines a barrier as "something material that blocks or is intended to block passage;" see, https://www.merriam-webster.com/dictionary/barrier. While not mentioned in the dictionary definition, simultaneously, a barrier can provide directional guidance. Common and most-often temporary pedestrian barriers are used for crowd control while providing visible notice to motorists. Heavy vehicle barriers afford additional protection to pedestrians from wrongly-directed vehicles, whether intentional or otherwise. At outdoor special events such as protests, demonstrations and/or other celebratory situations where large numbers of people will openly congregate, barriers are often placed about and around the peripheries to delineate approved and unapproved pedestrian areas and also to prevent potentially high casualty vehicular incidents. Temporary barriers have become a necessary means of pedestrian guidance and protection, but they are unappealing to look at and provide no ambient light under darkness to increase their visibility.

A "Jersey Barrier" is one of the more common barriers. A Jersey Barrier is shown and described in Wikipedia at https://en.wikipedia.org/wiki/Jersey_barrier. Jersey Barriers are available in varying sizes. As disclosed in Wikipedia, a common Jersey Barrier stands 32 inches (81 centimeters) tall and is made of steel-reinforced poured concrete or plastic. A Jersey Barrier has a base portion having a trapezoidal cross-section. Disposed on this base portion is vertical wall portion having a rectangular cross-section or a modified rectangular cross-section with slightly sloping sides (technically, a trapezoidal cross-section.) In the underside of the base portion there can be through cavities for engagement by the forks of a forklift truck to facilitate transport and placement of the Jersey Barrier. A Jersey Barrier can feet on which it is supported and concomitant gaps between the feet. A Jersey Barrier can have eye-hooks embedded into its sides.

The term "Jersey Barrier" as used herein encompasses a Jersey Barrier itself and derivative and/or improved designs for Jersey Barriers; for example, the F-shape barrier which is similar to the Jersey Barrier wherein the base portion is lower and the slope a bit flatter. There is an extensive discussion of derivative and/or improved designs for Jersey Barriers in Wikipedia and the references cited in Wikipedia.

A system for illuminating an iron bar style barrier is taught in United Kingdom Patent Application Publication GB 2527583 by Nickos Koulouris et al. (filed Jun. 26, 2014) which is entitled Uplighting/Downlighting Barrier System. As mentioned, the patent application publication relates to portable iron bar style barriers comprised of a tubular rectangular perimeter frame supported vertically by feet which rest on the ground with a plurality of vertical tubular struts within the perimeter frame. The patent application provides an enabling disclosure for constructing a weather proof lighting system with an elongated illumination means, a housing and weather proof electrical wiring and connections. This weather proof lighting system is attached to the portable barrier by way of U-shaped spring clips. The patent application publication makes reference to the lighting system being energized by an external power supply; however, there is no greater teaching on this power supply other than to recite that it is provided on the aforementioned housing. The patent application teaches the use of a commercially available lighting controller.

A system for attaching a graphic to a parking pylon is taught by U.S. Pat. No. 6,692,182 B1 by Scott Fenimore et al. (filed Aug. 27, 2002) which is entitled Vehicle Barrier/Advertisement System. As mentioned, the patent relates to a parking pylon and the title using the word "barrier" is a misnomer in as much as the "barrier" is disclosed to have a height of about 7.25 inches, a maximum width of about 7.25 inches and a length of about 60 inches. The patent teaches a thin barrier cover fabricated from extruded polyvinyl chloride having a thickness of about 0.125 inches that is sized and shaped to be conformingly positioned over the barrier. A print graphic can be attached to this thin barrier cover. The patent provides sketchy teaching of a system for holding the barrier cover to the barrier. This system is comprised of rectilinear recesses running transverse across the underside of the base of the barrier; slots in the barrier cover that are in alignment with these recesses; a strap that loops around the slot and is positioned in the recess; a toothed surface on one end of the strap and a tooth keeper at the other end. The tooth keeper receives the toothed end and is positioned in contact with an associated slot to hold the cover in contact with the barrier.

A system for snap fitting an amenity (e.g., a flower pot) to a specially modified Jersey Barrier is taught by US Patent Application Publication US 2004/0197140 A1 by Matthew Malesks et al. (filed Apr. 1, 2004) which is entitled Attachable Traffic Barrier Amenities. As mentioned, the patent application publication teaches a "snap-to-fit" attachment for a Jersey Barrier which has been specially redesigned so as to be able to cooperate with the "snap-to-fit" attachment. The standard Jersey Barrier is redesigned by modifying the uniform sized trapezoidal base portion to have a configuration of larger size trapezoidal regions with interstitial smaller size trapezoidal regions. The result is the creation of channels in the base portion to receive legs from an amenity. Illustrated is the attachment of a flower box assembly comprised of a flower box with four depending legs having flexibility. At the end of each leg is an inwardly directed perpendicular flange. The flower box assembly is disposed downwardly onto the Jersey Barrier with the legs being received in the channels and the perpendicular flanges engaging the underside of the base of the Jersey Barrier.

A barrier having a columnar vertical support posts with an arcuate roof is taught by European Patent Application Publication EP1619324 by Gleis Sekuritaet (De) (filed Jul. 22, 2005) which is entitled Barrier for Construction Sites. The patent application publication teaches an expandable scissor-like frame assembly having vertical support post when the assembly is expanded. There is a curved roof mounted to vertical support posts. When the assembly is expanded, it is rigid. In particular, there is a transverse beam and attachment to a trolley cart such that the arc shape roof member has no flexibility.

Adding electronics to a barrier is taught by U.S. Pat. No. 9,334,686 B2 by Mark Oakes et al. (filed Jul. 11, 2014) which is entitled Integrated Security Barrier Control System. The patent provides an enabling disclosure for integrating programming logical controllers, monitoring devices and reporting devices into a barrier. The patent recites a barrier power unit with no greater disclosure than it powers the barrier.

The art of barriers is deficient in that barriers remain unattractive, even after adding a flower pot. The barriers still give an area in which they are placed a militaristic look.

The art of barriers is deficient in that barriers are not conducive to messaging, even after adding a print graphic. The print graphic is insufficiently visible and more is needed to achieve safety.

The art of barriers is deficient in that amid lower ambient light, including dusk, dawn, and times of inclement weather, the barrier's visibility is limited. Further, a Jersey Barrier does nothing to enhance ambient lighting.

There exists a need for barriers having an attractive appearance.

There exists a need for barriers with increased visibility.

There is a need for barriers that have replaceable graphics with enhanced public messaging (e.g. signage, directions, promotions, etc.) that is simply and easily replaced. There is a companion need for barriers that have graphics which diffuses the brightness of lighting in the area to increase visibility of the graphic.

There is a need for barriers which offer additional light to an area.

There exists a need for retrofits to Jersey Barriers to increase the "visible size" of the barriers while only minimally increasing the barrier's height and footprint. There is a companion need for a simple and easy to use retrofit for Jersey Barriers that have already been put in place in a head-to-tail configuration forming a barrier train.

There is a need for barriers that have a power system that provides the power which is required by lights to illuminate the barrier. There is a companion need for a barrier that has a power system which is theft resistant. There is a companion need for barriers that have a power that is controllable through circuitry.

There is a need for barriers that have a system for transmitting the barrier's status through the internet including, for example, the barrier's physical status, notification of a vehicular impact, and the location of the barrier to monitors such as first responders and maintenance technicians. There is companion need for barriers that have the capability of feeding real-time circuit monitoring data (e.g. battery status and brightness levels) to such monitors.

The present invention satisfies these needs, as well as others, and generally overcomes the presently known deficiencies in the art.

SUMMARY OF THE INVENTION

The present invention is directed to illuminated barrier apparatuses.

An object of the present invention is an attractive barrier apparatus.

Another object of the present invention is a barrier apparatus that is conducive to highly visible messaging. A companion object of the present invention is a barrier apparatus that has messaging which is simply and easily replaced. Another companion object of the present invention is a barrier apparatus with messaging that diffuses the brightness of lighting in the area to further increase the high visibility of the messaging.

Another object of the present invention is a barrier apparatus that is visible amidst low ambient light.

Another object of the present invention is a barrier apparatus that enhances ambient lighting.

Another object of the present invention is a barrier apparatus that retrofits to Jersey Barriers.

Another object of the present invention is a barrier apparatus that is interoperable to retrofit onto all of a plurality of Jersey Barriers in a head-to-tail configuration (i.e., a daisy chain or train of Jersey Barriers) with a "left" end Jersey Barrier, intermediate Jersey Barriers and a "right" end Jersey Barrier.

Another object of the present invention is a barrier apparatus that has a battery power system that is theft resistant. A companion object of the present invention is a barrier apparatus that has a controller that is theft resistant.

Another object of the present invention is a barrier apparatus that transmits the barrier's status through the internet including, for example, the barrier's physical status, notification of a vehicular impact, and the location of the barrier apparatus. A companion object of the present invention is a barrier apparatus which transmits real-time circuit monitoring data.

One aspect of the present invention is an illuminated barrier apparatus. The illuminated barrier apparatus either directly or indirectly rests on the ground. The ground defines a frame of reference establishing a "lower," an "upper," a "horizontal" and a "vertical."

The illuminated barrier apparatus has a base. This base is lower. The base has a first approximately horizontal elongated longitudinal member and a second approximately horizontal elongated longitudinal member. These approximately horizontal elongated longitudinal members are approximately laterally opposing and spaced apart and are in substantial alignment.

There is a plurality of cross-sectional members. The cross-sectional members span cross-wise between the first and second approximately horizontal elongated longitudinal members. Typically, a cross-sectional member has a pair of approximately oppositely opposed vertical members extending approximately upwards from the approximately horizontal elongated longitudinal members and at least one roof member spanning between the vertical members. This assembly of a base and cross-sectional members has ends.

There is a tent-like covering. This tent-like covering is received on the assembly of the base and the cross-sectional members. The tent-like covering is substantially translucent. It substantially encloses the assembly of the base and the cross-section members. The tent-like covering is fastened by way of a means for fastening to the assembly of the base and the cross-section members. Consequently, there is an enclosed volume defining an "inner" and an "inwardly" direction.

A lighting system that is inner is coordinated to the assembly of the base and the cross-section members. This lighting system substantially illuminates the tent-like covering. The lighting system has one or more illumination means. There is a wiring circuit for electrical communication.

The illuminated barrier apparatus has a set of adaptions. One set of adaptions is for an illuminated enclosure retrofit. Another set of adaptions is for a standalone illuminated barrier.

A version of a set of adaptions for an illuminated enclosure retrofit includes: (i) adapting the roof members to have the property of being resilient and (ii) one or more flanges which each extends inwardly from an approximately horizontal elongated longitudinal member and capable of following the profile of a Jersey Barrier as this illuminated barrier apparatus is mounted on a Jersey Barrier in a downward fashion. The flanges are positioned so as to be capable of engaging a forklift fork cavity of a Jersey Barrier when this illuminated barrier apparatus is mounted on a Jersey Barrier.

The result being that the span of the cross-section members expand against the resilient force of the roof members as this illuminated barrier apparatus is mounted on a Jersey Barrier in downward fashion. The resilient force of the roof members urge the approximately horizontal elongated longitudinal members against the Jersey Barrier and urge the flanges into the forklift fork cavities of the Jersey Barrier. The result being the provision of a stabilization force to stabilize this illuminated barrier apparatus on a Jersey Barrier to which it is mounted.

A version of the set of adaptions for a standalone illuminated barrier includes (i) at least one transverse members spanning between the first and second approximately horizontal elongated longitudinal members of the base; (ii) an opening whereby a battery can be passed; (iii) a pair of oppositely opposed support arms upwardly appending from members of the base and (iv) a battery box cradle rotatably mounted to the support arms. Accordingly, when this standalone illuminated barrier is rotated towards ground, components disposed in the cradle remain upright and the components being accessible through the opening.

Another aspect of the present invention is an illuminated barrier apparatus equipped with solar panels, sensors, a controller, an alarm and an Internet of Things (IoT)/cellular communicator.

Another aspect of the present invention is a method for using an illuminated barrier apparatus. This method is comprised of the steps of: (1) deploying an illuminated barrier apparatus; (2) selecting out that illuminated barrier apparatus where the tent-like covering is in a state for replacement; (3) undoing the means for fastening this tent-like covering to the assembly of the base and the cross-section members of the illuminate barrier apparatus; (4) clearing the tent-like covering which is in a state for replacement away from the assembly of the base and the cross-section members and (5) fastening a replacement tent-like covering to the assembly of the base and the plurality of cross-section numbers.

The previously described aspects of the present invention have many advantages. These advantages include improved barrier visibility, better visibility of warning signs displayed on the barrier, aesthetic beauty, adding light to an area surrounding the barrier, an automated system to report an incident to first responders, and the ability to display advertising on the barrier.

BRIEF DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
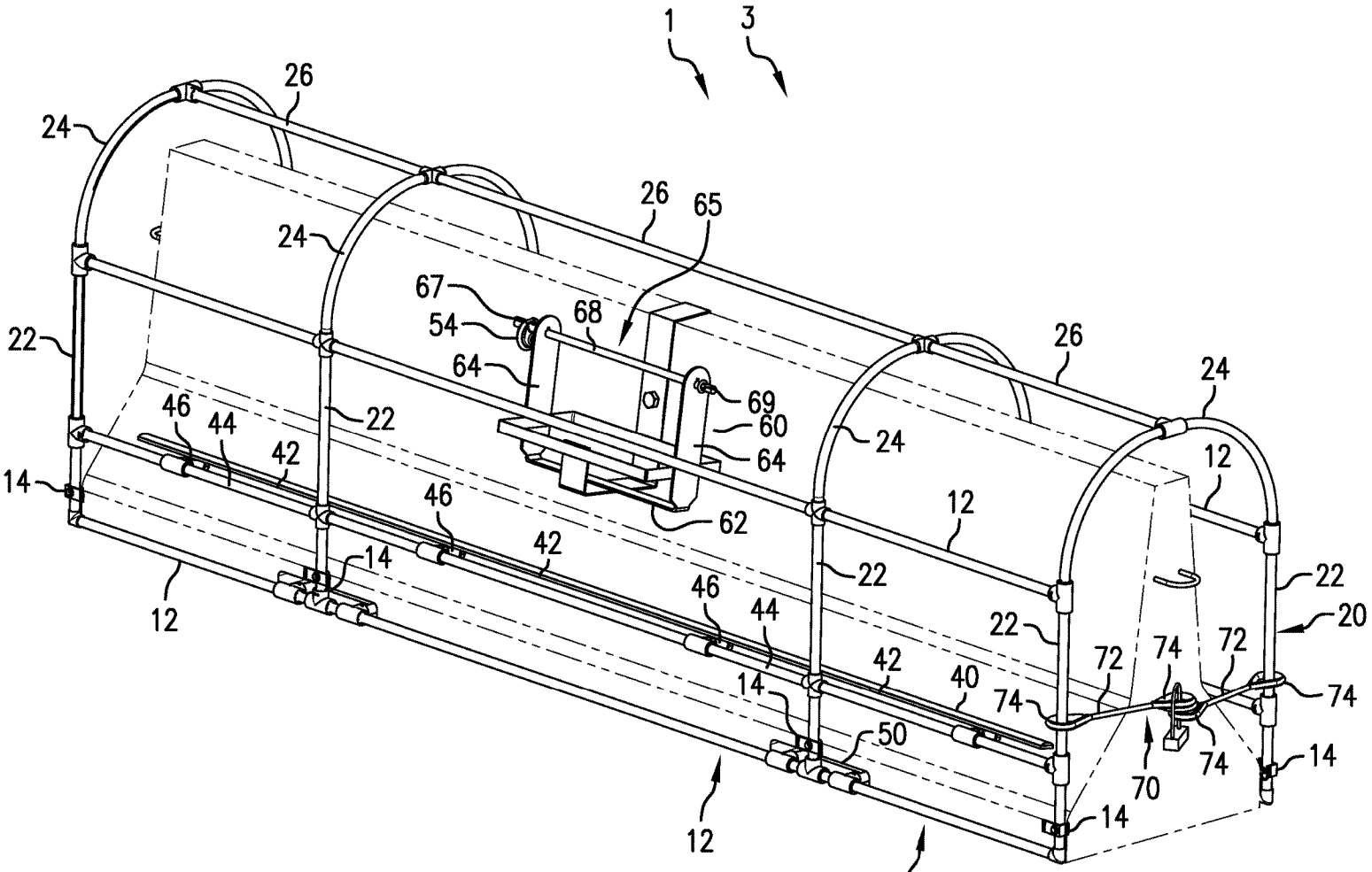
FIG. 1 shows an environmental perspective view of the frame of an illuminated enclosure retrofit embodiment according to the present invention shown in a state of use with a Jersey Barrier in dashed lines (sometimes, less than accurately referred to as in "relief;")

The present invention is described more fully in the following disclosure. In this disclosure, there is a discussion of embodiments of the invention and references to the accompanying drawings in which embodiments of the invention are shown. These specific embodiments are provided so that this invention will be understood by those skilled in the art. This invention is not limited to the specific embodiments set forth herein below and in the drawings. The invention is embodied in many different forms and should be construed as such with reference to the appended claims.

Referring to the drawings collectively, in general terms and for an overview, embodiments of this illuminated barrier apparatus (1) invention are comprised of the following major components or subassemblies: a base (10); cross-sectional members (20); a tent-like covering (30); a lighting system (40) and adaptions to be an illuminated enclosure retrofit embodiment (3) for a Jersey Barrier or adaptions to be a standalone illuminated barrier embodiment (5). In the discussion that follows, each of these major components or subassemblies is discussed, along with other structures in the embodiments of this invention such as flanges (50) and a battery cradle (60) along with associated battery box (63), circuitry and sensors. Thereafter, there is a discussion on how to use the embodiments of this invention.

Figure 2:
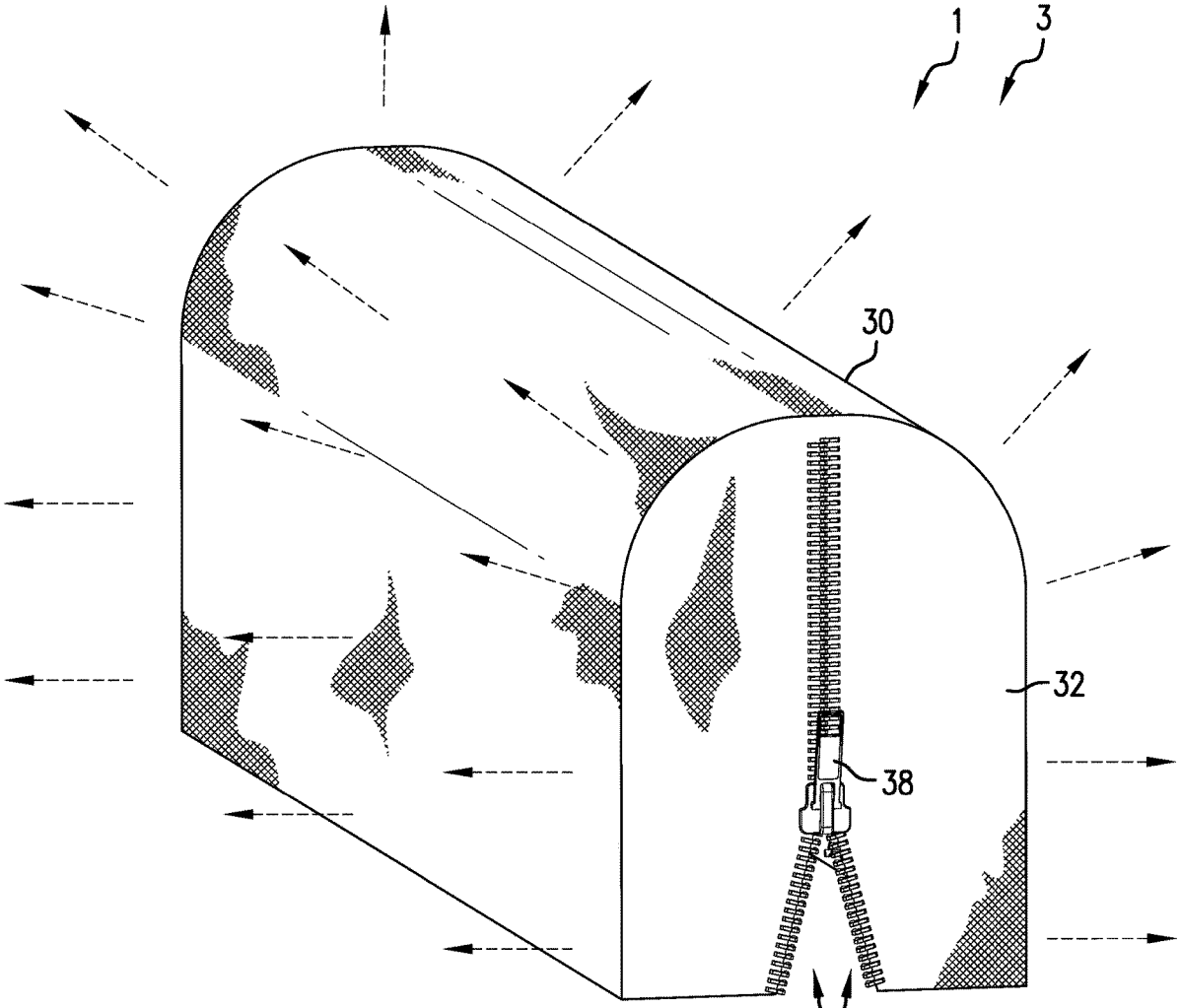
FIG. 2 shows an environmental perspective view of an illuminated enclosure retrofit embodiment according to the present invention in state of use with arrows indicating illuminating light and out of scale zipper.

Referring to FIGS. 1 and 2, embodiments of this invention are adapted to be an illuminated enclosure retrofit (3) for a Jersey Barrier. An illuminated enclosure retrofit embodiment (3) mounts on a Jersey Barrier which rests on the ground. The ground defines a frame of reference establishing a "lower," an "upper," a "horizontal" and a "vertical."

Figure 3:
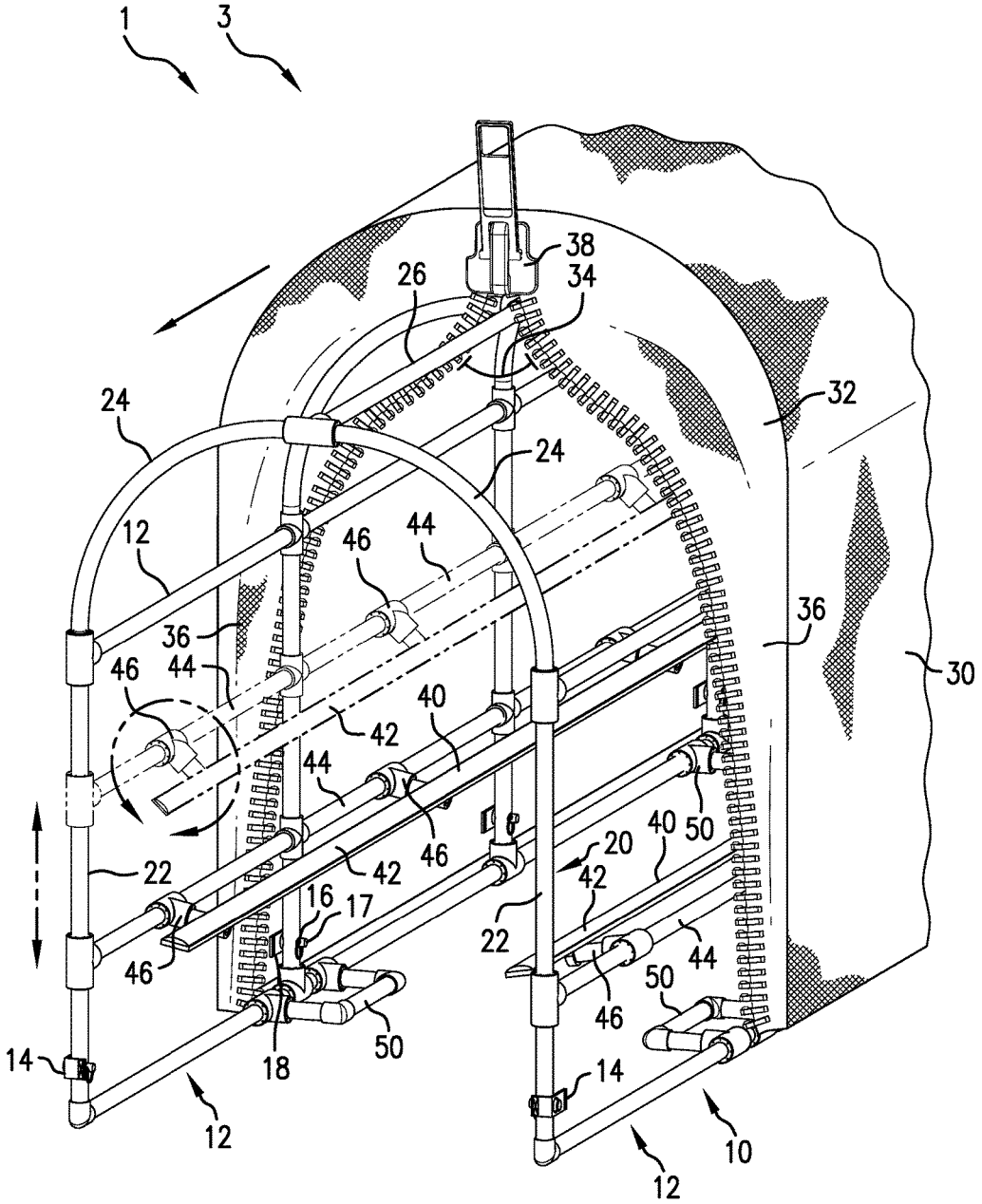
FIG. 3 shows an end partial perspective view of an illuminated enclosure retrofit embodiment according to the present invention with the tent-like covering translocated in position for the purposes of illustration, and out of scale zipper and arrows to indicate states of use.

Referring to FIGS. 1 and 3, there is a base (10) that is lower. This base has a first and second approximately horizontal elongated longitudinal member (12). Each approximately horizontal elongated longitudinal member (12) provides structural support. The first and second approximately horizontal elongated longitudinal members (12) run approximately horizontal and parallel to the ground, are laterally opposed to each other and are spaced apart. Typically, they are in substantial alignment. The approximately horizontal elongated longitudinal members (12) are approximately horizontal and can angle upward, angle downward, be triangular like with two segments angling upward that meet at a vertex, be inverted triangular like with two segments angling downward that extend from a vertex, be a zigzag of a plurality of segments or be a crisscross of two or more segments.

The approximately horizontal elongated longitudinal members (12) are elongated longitudinal members configured to be linear, substantially linear, wavy, arcuate, or irregularly shaped with substantially linear and linear more preferred. Typically, the approximately horizontal elongated longitudinal members (12) have a cross-section that is square, rectangular, circular, oval, polygonal, or irregularly shaped with rectangular and circular preferred and circular more preferred.

This base (10) and other structural components described herein are preferably made out of plastic or metal. For members that are upper, plastic is a preferred material and polyvinyl chloride (PVC) is a more preferred plastic. Alternatively, other structural materials of varying flexibility, strength, impact resistance and other physical properties may be affected to meet specific needs of the end user.

Continuing to refer to FIGS. 1 and 3, there is a plurality of cross-sectional members (20). Each cross-sectional member (20) is comprised of a pair of approximately oppositely opposed vertical members (22) extending approximately upwards and a at least one roof member (24) spanning between the vertical members (22). The oppositely opposed vertical members (22) are vertically-oriented elongated columns. Vertical members (22) provide structural support and contribute to supporting the roof members (24) (further discussed herein below.) Typically, the vertical members (22) have a cross-section that is square, rectangular, circular, oval, polygonal, substantially polygonal or irregularly shaped with circular preferred.

Each cross-sectional member (20) spans cross-wise between the first and second approximately horizontal elongated longitudinal members (12). The pair of approximately oppositely opposed vertical members (22) are upwardly attached to approximately horizontal elongated longitudinal members (12) using common PVC slip fittings, in the preferred case of members being PVC pipe. The assembly of the base (10) and the cross-sectional members (20) has ends (head and tail) and sides (front and rear). Other components attached to assembly of the base (10) and the cross-sectional members (20) as discussed below.

Roof members (24) span between the approximately oppositely opposing vertical members (22). There is at least on roof member (24) spanning between approximately oppositely opposing vertical members (22). Roof members (24) provide structural support and function as a frame upper. Preferred configurations for the roof member are linear, "V" shaped and arcuate. Most preferred is an arcuate roof member (24) that is about 180-degrees (a half-circle.) Typically, the roof member (24) has a cross-section that is square, rectangular, circular, oval, polygonal, or irregularly shaped with circular preferred.

Figure 7A:
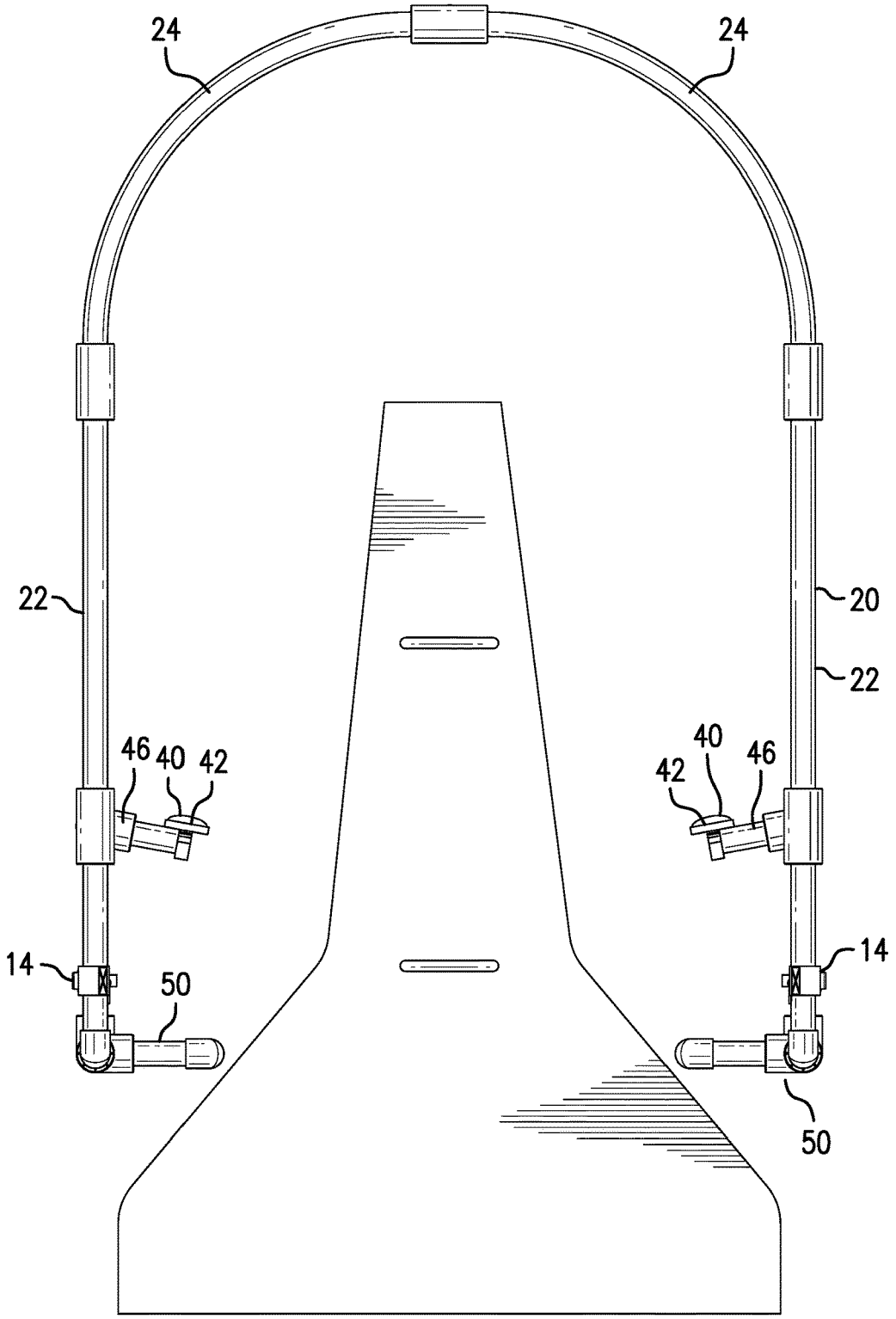
FIG. 7A shows an environmental end elevation view of an illuminated enclosure retrofit embodiment according to the present invention in state of use of being mounted on a Jersey Barrier.
Figure 7B:
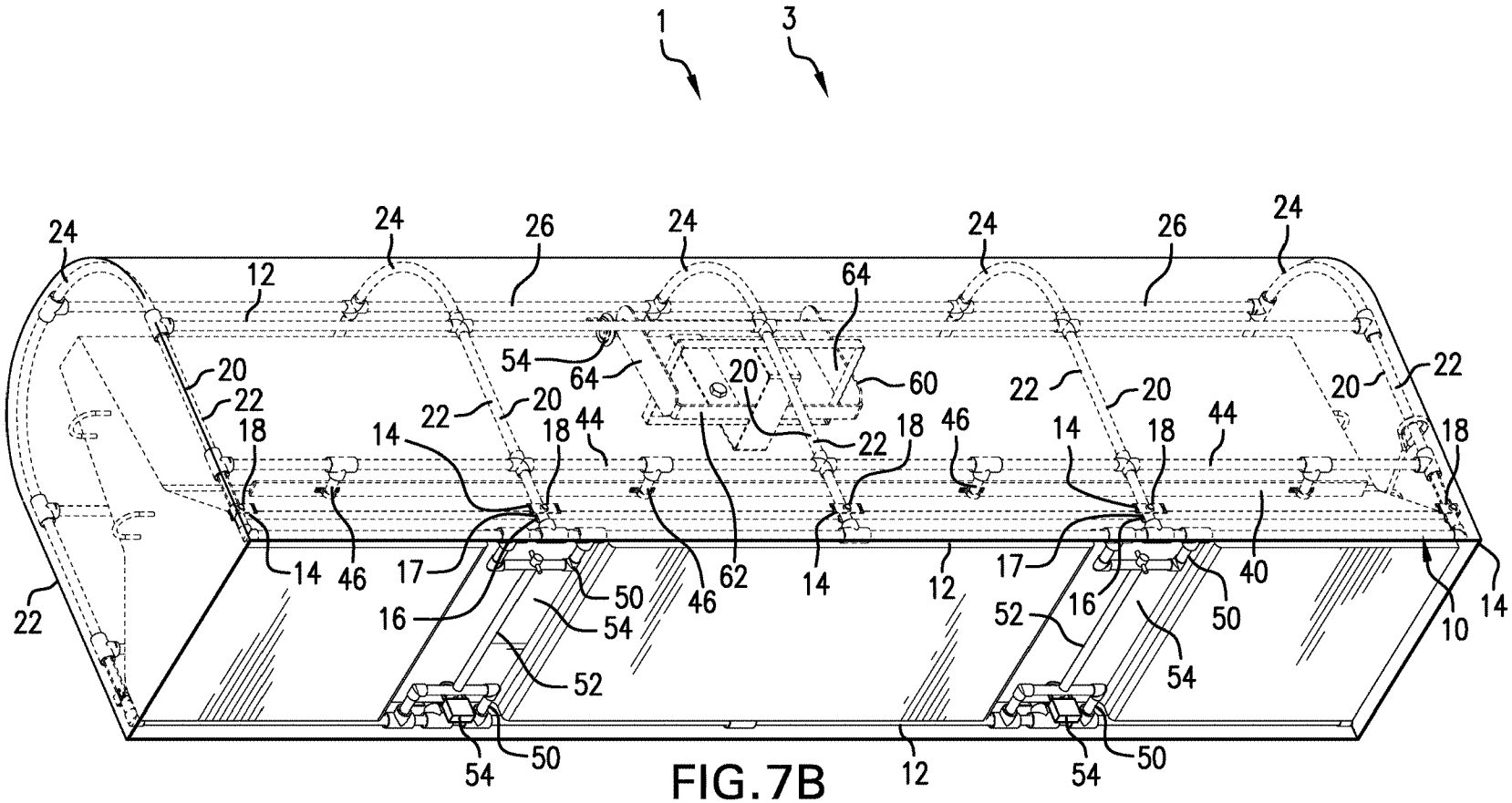
FIG. 7B shows an environmental perspective view of an illuminated enclosure retrofit embodiment according to the present invention in state of use of being mounted on a Jersey Barrier with the foregoing rotated counter-clockwise for the purposes of illustration.

Referring to FIGS. 7A and 7B, the roof member (24) is flexible and resilient. As discussed in greater detail herein below, the illuminated enclosure retrofit embodiment (3) gets mounted downwardly on a Jersey Barrier. The roof member (24) is of sufficient flexibility that as the span of the cross-section member (20) expands, the roof member (24) bends outward without kinking or breaking. The roof members (24) are of sufficient resilience to generate an inwardly directed force concomitant with the roof members (24) being bent outwardly that as the illuminated enclosure retrofit embodiment (3) is further mounted downward on the Jersey Barrier such that the roof members (24) urge flanges (discussed below) into forklift fork cavities of the Jersey Barrier or gaps between feet on the Jersey Barrier. A result being the provision of stabilization of the illuminated enclosure retrofit embodiment (3) on the Jersey Barrier to which it is mounted. These parameters are achievable with PVC piping having a circular cross-section and PVC piping having a circular cross-section is preferred.

Returning to FIGS. 1 and 3, optionally, there can be a central beam (26) spanning across the roof members (24) of the plurality of cross-sectional members (20). This central beam (26) adds additional structural support and assists in keeping the cross-sectional members (20) spaced apart. Optionally, there can be additional approximately horizontal elongated longitudinal members (12) at various vertical heights spanning across the vertical members (22) of the plurality of cross-sectional members (20). Such additional approximately horizontal elongated longitudinal members (12) add additional structural and lighting support and assists in keeping the cross-sectional members (20) spaced apart. The assembly of the base (10), cross-sectional members (20) and optional central beam (26) is sometimes referred to as the "frame."

Referring to FIGS. 3, 6, 7A and 7B, in embodiments of this invention, optionally and preferably, there are one or more flanges (50) extend inwardly from a member (12, 22) and preferably extend from an approximately horizontal elongated longitudinal member (12). These flanges (50), to be capable of engaging a forklift fork cavity of a Jersey Barrier or gap between feet all the Jersey Barrier when this illuminated enclosure retrofit embodiment (3) of this invention is mounted on a Jersey Barrier, are positioned so as align with, and not to conflict with, forklift fork cavities or gaps between any feet on the bottom of Jersey Barrier. These flanges (50) are approximately perpendicular appendages to the member (12, 22) from which they extend and again, preferably extend from an approximately horizontal elongated longitudinal member (12). If there are multiple approximately horizontal elongated longitudinal members (12) running along a side of an assembly of a base (10) and the cross-sectional members (20) at various vertical heights, then the flanges (50) protrude from the lowest approximately horizontal elongated longitudinal members (12).

Preferably, there are flanges (50) on both opposing sides (front and rear) of the base (10). Optionally, the flanges (50) extend inwardly from an approximately horizontal elongated longitudinal member (12) on slip fittings, instead of a rigid attachment. This allows the flanges (50) to rotate out for easier disassembly and/or easier engagement of a flange attaching assistant attachment means (52) (discussed below) to the benefit of making the illuminated enclosure retrofit embodiment (3) harder to steal.

Conceptual, the flanges (50) resemble the form and location of incisor teeth. The flanges (50) are capable of following the profile of a Jersey Barrier as an illuminated enclosure retrofit embodiment (3) is mounted on a Jersey Barrier in a downward fashion. As the illuminated enclosure retrofit embodiment (3) is forced down on the Jersey Barrier, the flanges (50) like "teeth" engage the sloped sides of the base of a Jersey Barrier, forcing apart the two sides of an assembly of a base (10) and the cross-sectional members (20). The resiliency and flexibility of the upper roof member (24), most preferably an about 180 degree upper arcuate roof member (24), makes this possible (as mentioned above.) Further, the teeth-like engagement of the flanges (50) against the sloped wall of the base of a Jersey Barrier inhibits the assembly of a base (10) and cross-sectional members (20) from twisting. Alternatively, the flanges swivel about the horizontal elongated longitudinal members using slip fittings and a locking cable (56) (discussed further below) between two opposing flanges (50) which further secures the illuminated enclosure retrofit embodiment (3) to the Jersey Barrier.

Just before the flanges (50) would reach the ground as an illuminated enclosure retrofit embodiment (3) embodiment is mounted on a Jersey Barrier in a downward fashion, they mate-up with either a gap between feet (the feet keep the majority of the bottom the Jersey Barrier off the ground) or the forklift fork cavities of the Jersey Barrier (used for lifting the Jersey Barrier.) The outwardly extended assembly of a base (10) and the cross-sectional members (20) substantially relaxes to its homeostatic/unextended resting shape and the flanges (50), in the fashion of a gear tooth engaging a gear, engages the gap at the bottom of the Jersey Barrier resting on feet or the forklift fork cavity. Thus, the span of the cross-section members (20) expanded against the resilient force of the roof members (24) as the illuminated enclosure retrofit embodiment (3) was mounted on a Jersey Barrier in downward fashion and the resilient force of the roof members (24) urged the approximately horizontal elongated longitudinal members (12) against the Jersey Barrier and urged the flanges (50) into the forklift fork cavity or gap between the feet of the Jersey Barrier so as to provide stabilization of this illuminated enclosure retrofit embodiment (3) mounted on the Jersey Barrier.

Figure 5:
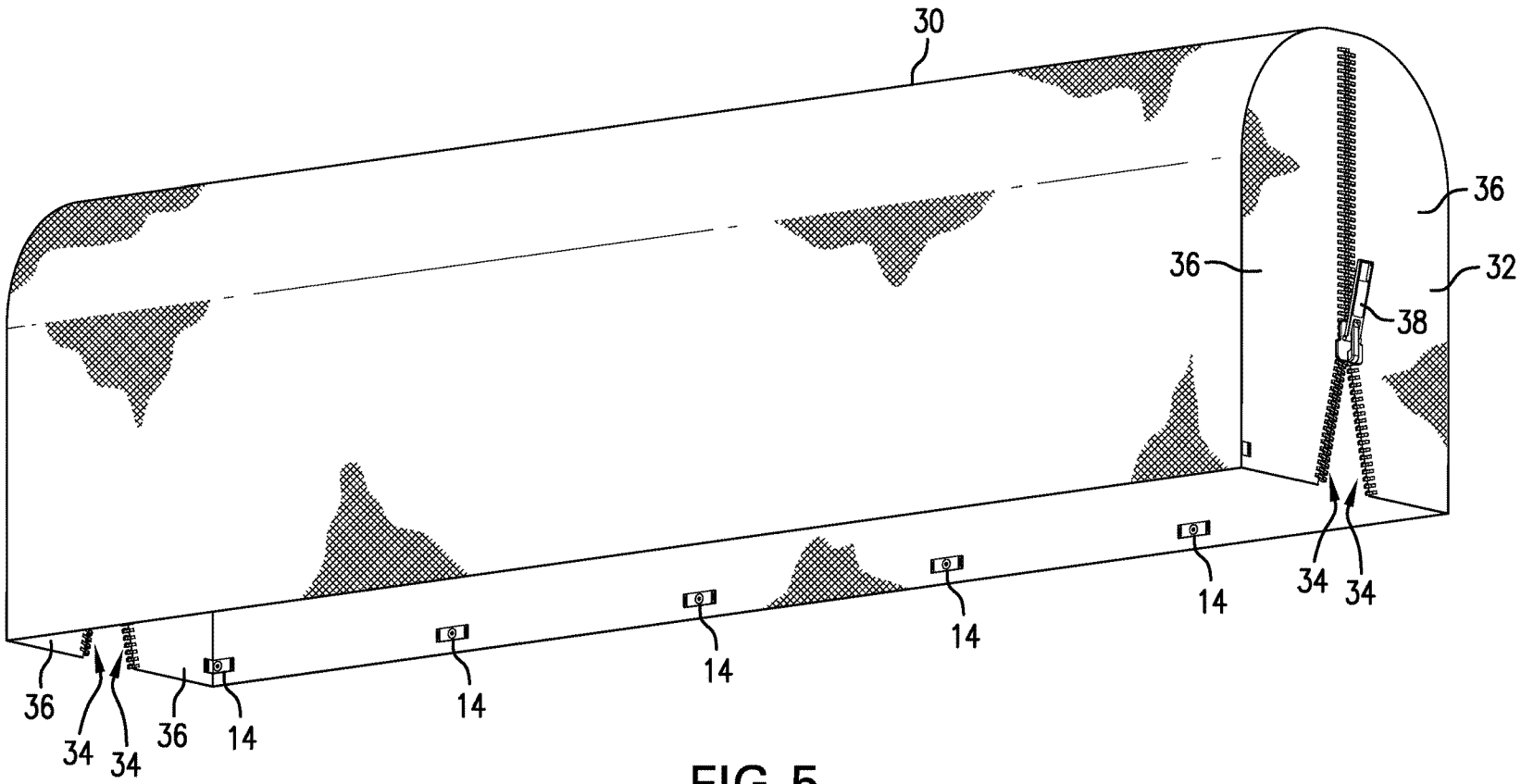
FIG. 5 shows a perspective view of a tent-like covering for an illuminated enclosure retrofit embodiment according to the present invention with an exaggerated out-of-scale zipper and grommet tapes.

Referring to FIGS. 2, 3 and 5, there is a tent-like covering (30). The tent-like covering (30) is sized and shaped to be conformingly receivable on an assembly of a base (10) and cross-sectional members (20) and to substantially enclose the assembly of a base (10) and cross-section members (20). The mounting of the tent-like covering (30) on an assembly of a base (10) and cross-sectional members (20) encloses a volume. This enclosed volume defines an "inner" and an "inwardly" direction and everything outside the volume is "outer" and in an "outward" direction.

The tent-like covering (30) is substantially translucent. Preferably the tent-like covering (30) is made out of a translucent fabric (woven or non-woven) or thin plastic sheeting. More preferably, the tent-like covering (30) is made out of a material having the additional properties of being elastomeric and flexible material. Most preferably, the tent-like covering (30) is made out of translucent woven stretch fabric so as to best conform about the frame (10) and cross-sectional members (20), regardless of dimension flaws in either the tent-like covering (30) or an assembly of a base (10) and cross-sectional members (20). Other materials that are not inherently translucent can be configured and processed to be substantially translucent via an array of light emitting perforations/apertures, slits, windows, gaps, block-outs, frosting, metalizing, polarizing or combination of the foregoing.

Optionally, the tent-like covering (30) is graphically enhanced with public messaging (e.g. signage, directions, promotions and etc.) This public messaging diffuses the brightness of the interior lights, as with lamp shades, and adds to the substantially translucent-like property. This graphical enhancement can be printed on the tent-like covering (30). U.S. Pat. No. 6,692,182 B1 by Scott Fenimore et al. (filed Aug. 27, 2002) which is entitled Vehicle Barrier/Advertisement System teaches a system for attaching a graphic to a sheet extrusion of polyvinylchloride. For the purposes of enablement, this teaching is incorporated herein by reference with the same effect and force as if fully stated herein below.

Figure 6:
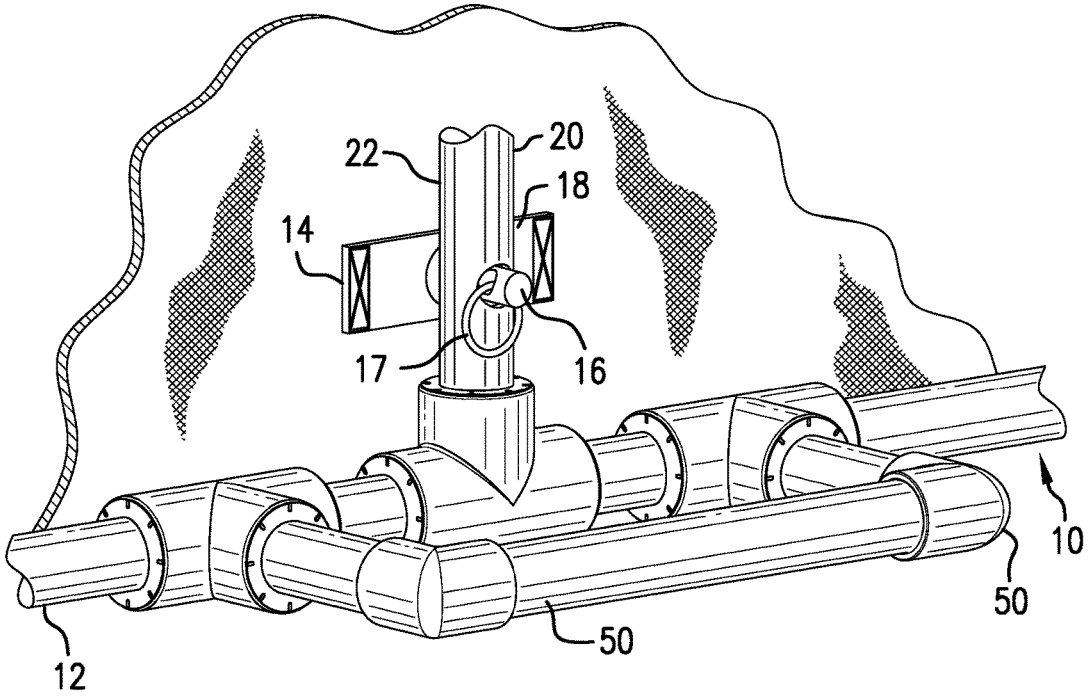
FIG. 6 shows a partial perspective view of a fragment of a frame of an illuminated enclosure retrofit embodiment according to the present invention featuring an approximately horizontal elongated longitudinal member, a flange, vertical member, cut-away of a tent-like covering and quick release fastener.

Referring to FIG. 6, the tent-like covering (30) is fastened by way of a means for fastening (14) to the assembly of the base (10) and the cross-section members (20). Physical structures of this means for fastening (14) are penetrating fasteners (e.g., a nut and bolt) threaded fasteners (e.g., nipple and externally threaded tube) ties (e.g., wire ties) clips, buttons, snaps and quick release fasteners. Quick release fasteners are preferred means for fastening (14). A more preferred quick release fastener (14) is an assembly of a clevis pin (16), split rings (17) and grommet tape (18) (a strip with a through hole surrounded by a grommet) which can be sewn or otherwise attached to the tent-like covering (30). The head of the clevis pin (16) can be trapped between the tent-like covering (30) and the grommet tape (18). The means for fastening (14) can perform an additional function of attaching together approximately horizontal elongated longitudinal members (12) and vertical members (22).

Continuing to refer to FIGS. 2, 3 and 5, optionally and preferably, the tent-like covering (30) has end faces (32). More preferably, each end face (32) has a slit (34) running the substantial vertical length of the end face (32). This vertical splitting results in the end faces (32) of the tent-like covering (30) having flaps (36). Preferably, there is a means for closing (38) in conjunction with the flaps (36) and slit (34). Physical structures for this means for closing (38) are zippers, hook and loop arrays (commonly referred to by the "Velcro" brand name of a purveyor) a system of a clevis pin (16), grommet tape (18) and split ring (17), a system of a linear array of holes (preferably surrounded by grommets or heavy stitching) and metal wire or rope threaded through this hole array and systems of anti-theft securing devices (e.g., a shank lock inserted through holes (preferably surrounded by grommets or heavy stitching) in each of the flaps.) A zipper is a preferred means for closing (38).

Preferred embodiments having a tent-like covering (30) with end faces (32) with a slit (34) running the substantial vertical length of the end face (32) allow for illuminated enclosure retrofit embodiments (3) to be installed on a multiplicity of Jersey Barriers that have already been or will be lined up in a longitudinal head-to-tail configuration (daisy chain.) For purposes of discussion, one end of this configuration of a multiplicity of Jersey Barriers is deemed to define a left and the other end is deemed to define a right.

On the Jersey Barrier at the left end of the head-to-tail configuration, the tent-like covering (30) that was received on the assembly of the base (10) and the cross-sectional members (20) has the slit (34) on the left end face (32) closed and the slit on the other end face (32) open. On the one or more Jersey Barriers that are intermediate between the Jersey Barriers at the left and right ends of the head-to-tail configuration, the tent-like covering (30) that was received on the assembly of a base (10) and cross-sectional members (20) has the slits (34) on each of the end faces (32) open. On the Jersey Barrier at the right end of the head-to-tail configuration, the tent-like covering (30) that was received on the assembly of a base (10) cross-sectional members (20) has the slit (34) on the right end face (32) closed and the slit (34) on the other end face (32) open. Accordingly, the tent-like covering (30) is interoperable to be receivable on left end, intermediate and right end Jersey Barriers in a head-to-tail configuration of a multiplicity of Jersey Barriers.

Referring to FIGS. 1, 3, 7A and 7B, there is a lighting system (40) that is inner and coordinated to the assembly of the base (10) and the cross-section members (20) that substantially illuminates the tent-like covering. The lighting system (40) is comprised of one or more illumination means (42) and a wiring circuit for electrical communication. Physical structures of the illumination means are incandescent lamps, fluorescent bulbs, neon lights, flood lamps, light projectors (with and without image slides) digital light projectors, light emitting diodes (LEDs) and LED strips. Digital light projectors provide the greatest functionality with the simplest control whereby images can be projected onto the tent-like covering (30); however, digital light projectors and control circuitry is of higher cost compared to another illumination means. A preferred illumination means (42) from the perspective of balanced cost and utility is the LED strip. Different color LED strips can be used to multi-color the tent-like covering (30).

As mentioned above, United Kingdom Patent Application Publication GB 2527583 by Nickos Koulouris et al. (filed Jun. 26, 2014) which is entitled Uplighting/Downlighting Barrier System teaches a weather proof elongated illumination means. For purposes of enablement, the foregoing teaching in this patent publication is incorporated herein by reference with the same effect and force as if fully stated herein.

Continuing to refer to FIGS. 1, 3, 7A and 7B, the illumination means (42) is coordinated to the assembly of the base (10) and the cross-section members (20). The manner of coordination depends on the type of illumination means (42). Typically, the coordination is by attaching the illumination means (42) by supports (44) and/or brackets (46) to the assembly of the base (10) and the cross-section members (20). Less preferred in that the illumination means (42) be coordinated to the assembly of the base (10) and the cross-section members (20) by resting on the ground or on the Jersey Barrier in proximity to the assembly of the base (10) and the cross-section members (20). In coordinating the illumination means (42) to the assembly of the base (10) and the cross-section members (20), the illumination means (42) is positioned more upper or lower, depending on the type of the illumination means (42). Likewise, depending to type of illumination means (42), the illumination means is position more central or more in proximity to ends. The overall objective is to achieve a desired illumination of the tent-like covering (30).

A preferred support (44) for attaching the illumination means (42) to the assembly of the base (10) and the cross-section members (20) is a longitudinal support (44). Typically, the longitudinal support (44) runs the horizontal length of the assembly of the base (10) and the cross-section members (20). The longitudinal support (44) is either fixedly or rotatable mounted with bracket (46) to the assembly of the base (10) and the cross-section members (20). Accordingly, the direction of projection of illumination from the illumination means (42) can be set to a particular direction or be adjusted as desired, depending upon the reflective characteristics of the barrier's sloping face. An illumination means (42) is mounted to this longitudinal support (44). Accordingly, the illumination means (42) is inward and nestled in the gap between the assembly of a base (10) and cross-section members (20) with an attached tent-like covering (30) and the Jersey Barrier's sloping face. More preferably, longitudinal support (44) is positioned so as to be about as low to the ground as possible without increasing the footprint of the illuminated enclosure retrofit embodiment (3). In a most preferred embodiment, there are LED strips (42) mounted on longitudinal supports (44) running along opposing sides, front and rear, of the assembly of the base (10) and the cross-section members (20).

Once again, as mentioned above, United Kingdom Patent Application Publication GB 2527583 by Nickos Koulouris et al. (filed Jun. 26, 2014) which is entitled Uplighting/Downlighting Barrier System teaches attaching a weather proof elongated illumination means to elongated members of a barrier by way of U-shaped spring clips. For purposes of enablement, the foregoing teaching in this patent publication is incorporated herein by reference with the same effect and force as if fully stated herein.

The illumination means (42) can be fiber optics and be coordinated by being woven into the tent-like covering (30). U.S. Pat. No. 7,234,853 by Marcello Givoletti (filed Aug. 3, 2001) which is entitled Textile Product with illuminated fibres etc. teaches weaving optical fibers into a fabric with illumination of the fabric. For purposes of enablement, the foregoing teaching in this patent is incorporated herein by reference with the same effect and force as if fully stated herein.

Figure 9:
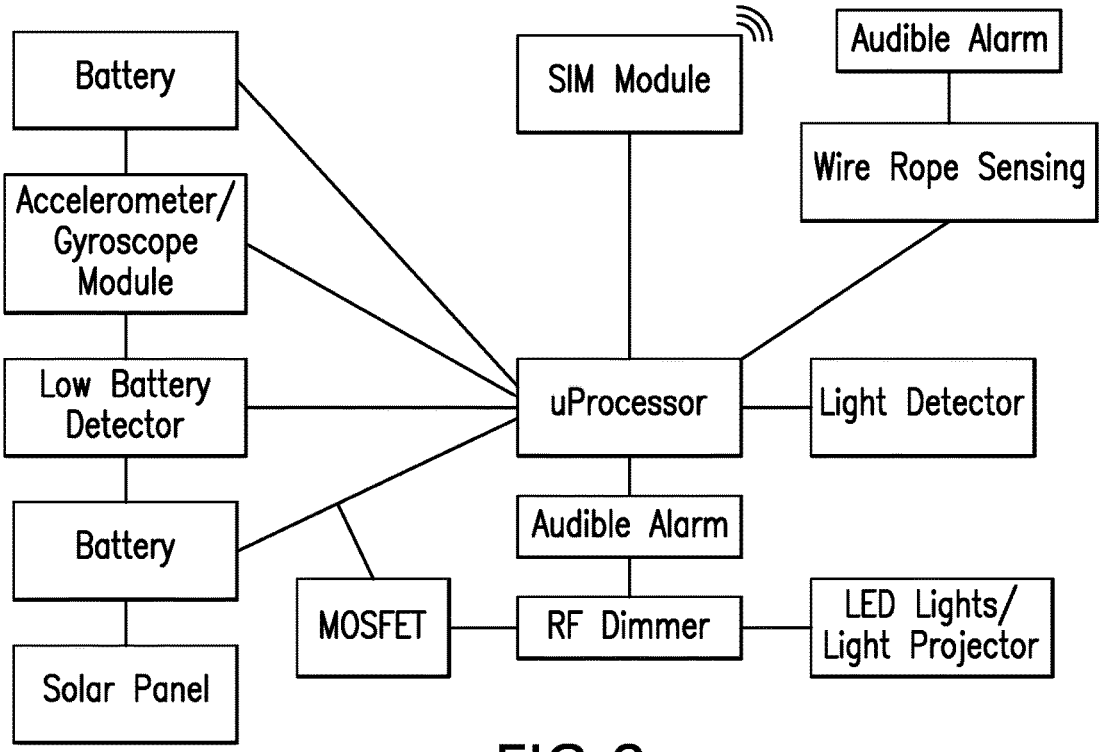
FIG. 9 shows a schematic drawing of a general arrangement of lighting circuitry, illumination means, batteries, solar panels, sensors, controller, alarm and a Internet of Things (IoT) communicator/cellular communicator of an illuminated barrier apparatus embodiment according to the present invention.

Referring to FIG. 9, there is a wiring circuit for electrical communication. Again, referring to United Kingdom Patent Application Publication GB 2527583 by Nickos Koulouris et al. (filed Jun. 26, 2014) which is entitled Uplighting/Downlighting Barrier System, there is teaching of a weather proof electrical wiring and connections for a lighting system. For purposes of enablement, the foregoing teaching in this patent publication is incorporated herein by reference with the same effect and force as if fully stated herein.

Referring to FIGS. 1, 4, 7B and 9, typically, in conjunction with an illuminated enclosure retrofit embodiment (3), there is a deep cycle battery for powering the wiring circuit for electrical communication and illumination means (42). In embodiments of this invention, optionally and preferably, there is a battery cradle (60) capable of receiving a battery box (63), to hold and protect the battery and circuitry, that is mountable to a Jersey Barrier and has a means for locking (65) the battery box (63) to the battery cradle (60).

Figure 4:
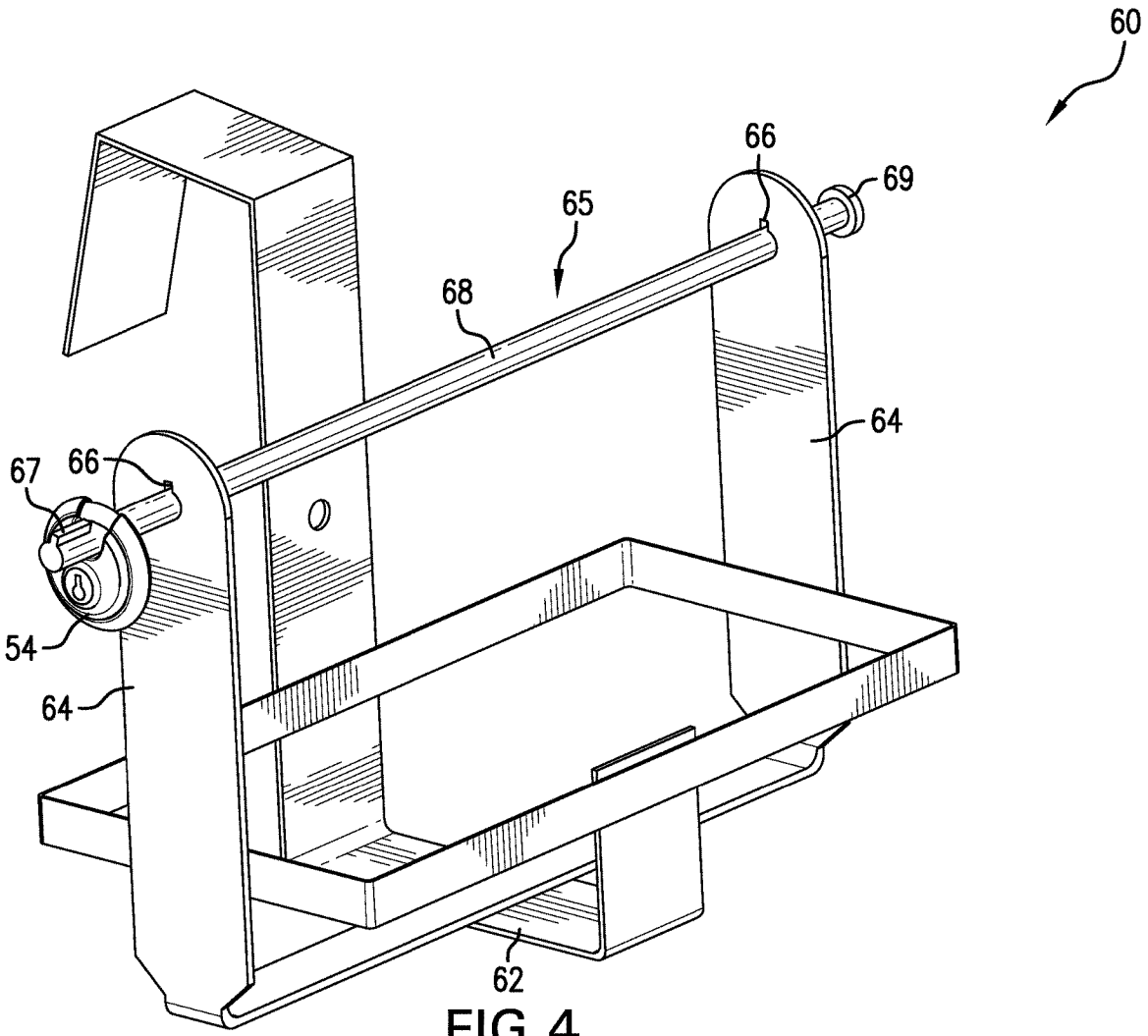
FIG. 4 shows a perspective view of a battery cradle for an illuminated enclosure retrofit embodiment according to the present invention.

Referring to FIGS. 1 and 4, more preferably, the battery cradle (60) has a lower battery box support (62). Perpendicular to this battery box support (62), there are a first and second spaced apart upwardly appending arms (64). Each upwardly appending arm (64) has a keyed hole (66) (a keyed hole means a hole with at least one radially outward buttressing slot.) The keyed hole (66) is sized to conformingly receive a keyed rod (68) (a keyed rod (68) is a rod having a keyed end (67) and a keyed end (67) is an end where there is extension tab or flange that runs from that end lengthwise along the perimeter of the rod for a short distance so as to have configuration like that of a simple skeleton key.) The first and second keyed holes (66) are positioned such that when a battery box (63) is seated on the battery box support (62) a keyed rod (68) running through the keyed holes (66) will buttress against the battery box. The non-keyed end of the keyed rod (68) is an oversized end (69) relative to the diameter of the keyed rod (68). An oversized end is made by attaching the rod end a ball cap, a disc cap, a clip or by swaging the rod end.

The battery cradle (60) typically has an inverted "U" shaped hanger hook that is capable of engaging the top portion of a Jersey Barrier. The inverted "U" shaped hanger hook is attached to the battery box support (61). The battery cradle is downwardly disposed onto the top of the Jersey Barrier and hangs in place by gravity. Optionally, the inverted "U" shaped hanger hook can be bolted to the Jersey Barrier.

A battery and circuitry can be locked for security against theft within the battery box (63) by seating the battery box (63) on the battery box support (62), running a keyed rod (68) that is slightly longer than the distance between the spaced apart upwardly appending arms (64) through the keyed holes (66) with the oversized end (69) buttressing against the keyed hole (66) in one of the upwardly appending arms (64) and the keyed end (67) in proximity to the other keyed hole (66) extending beyond the keyed hole the diameter of the shank of a padlock and fixing a padlock (54) shank conformingly around the keyed rod (68) between the keyed end (67) and the keyed hole (66).

Referring to FIG. 9, typically, one battery powers one illuminated enclosure retrofit embodiment (3). Optionally, more than one battery can be utilized with one illuminated enclosure retrofit embodiment (3). As mentioned above, illuminated enclosure retrofit embodiments (3) are suitable for being installed on a multiplicity of Jersey Barriers that have already been, or will be, lined up in a longitudinal head-to-tail configuration (daisy chain). One battery can power more than one illuminated enclosure retrofit embodiment (3). Optionally, solar panels can be located about the tent-like covering and supported by the assembly of a base (10) and a cross-section members (20). Solar panels will assist in recharging batteries and powering the wiring circuit for electrical communication. Optionally, direct current (DC) power adapters that modify alternating current (AC) power can be connected to the wiring circuits for electrical communication to power any and all individual illuminated enclosure retrofit embodiments (3), as well as recharging the deep cycle battery.

Continuing to refer to FIG. 9, in embodiments of this invention, optionally and preferably, there are one or more sensors in electrical communication with the wiring circuit for electrical communication selected from the group consisting of a low battery detector, sunlight detector, motion impact detector and global positioning satellite (GPS) system receiver. Optionally and preferably, with the sensors, there is an electronic control means for controlling that which is on the wiring circuit for electrical communication and is in electrical communication with the wiring circuit for electrical communication. Optionally and preferably, there is a subscriber identity module (SIM) mobile telephony transmitter means for transmitting in connection with the wiring circuit for electrical communication. This provides the capability of transmitting data. The controller and telephony transmitter means are preferably positioned in the battery cradle (60).

Continuing to refer to FIG. 9, a wiring circuit for electrical communication with electronic control means can have any or all of the following circuit behaviors:

(1) If there is a lack of sunlight, the light detector will cause the circuit to turn on the lights.

(2) If there is enough sunlight, the light detector will cause the lights to turn off.

(3) If motion is detected by the accelerometer/gyroscope module, including jarring/shock, said motion activates/de-activates an on-board audible alarm and causes a change in the accelerometer/gyroscope output signal to the microprocessor.

(4) Any and all other changes in status will be relayed through the SIM mobile telephony transmitter to notify the end user while a GPS system receiver module relays its location.

(5) A radio-frequency (RF) remote dimmer adjusts the light output

As mentioned above, United Kingdom Patent Application Publication GB 2527583 by Nickos Koulouris et al. (filed Jun. 26, 2014) which is entitled Uplighting/Downlighting Barrier System teaches the use of a commercially available lighting controller. Also as mentioned above, U.S. Pat. No. 9,334,686 B2 by Mark Oakes et al. (filed Jul. 11, 2014) which is entitled Integrated Security Barrier Control System teaches integrating programming logical controllers, monitoring devices and reporting devices into a barrier. For purposes of enablement, the foregoing teaching in each of these patents publication is incorporated herein by reference with the same effect and force as if fully stated herein.

Figure 8:
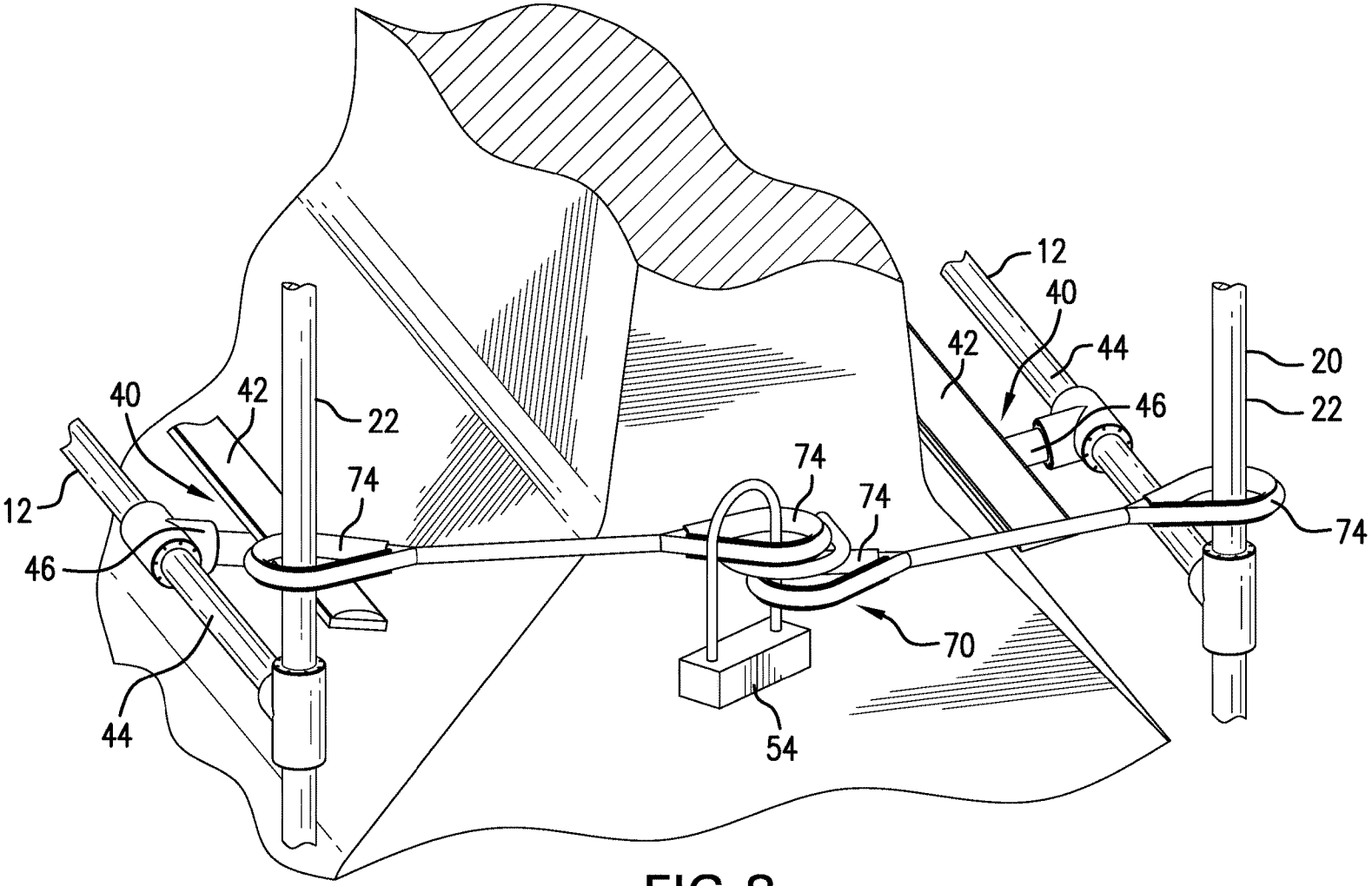
FIG. 8 shows a partial environmental perspective view of a fragment of a frame of an illuminated enclosure retrofit embodiment according to the present invention featuring an assistant attachment means locked to the eye-ring of a Jersey Barrier.

Referring to FIGS. 1, 7B and 8, in embodiments of this invention, optionally, there is an assistant attachment means (70). One physical structure of the assistant attachment means (70) is a pair of steel ropes or chains (72) with loops (74) at each end of the steel rope or chain (72). The loops (74) at one end of the pair of steel ropes or chains (72) are inserted on oppositely opposed vertical members (22) of a cross-sectional member (20) and so to speak lassoes the illuminated enclosure retrofit embodiment (3). The other loops (74) at the other ends of the pair of steel ropes or chains (72) are attached to an eye hook on the end of a Jersey Barrier using a padlock (54). This structure of the assistant attachment means (70) functions to prevent the illuminated enclosure retrofit embodiment (3) from being removed from a Jersey Barrier by restricting the illuminated enclosure retrofit embodiment (3) from being expanded/spread open without first unlocking the padlock (54) and freeing the loops (74) at the ends of the pair of steel ropes or chains (72). The result being that theft of the illuminated enclosure retrofit embodiment (3) is deterred. Optionally, the steel ropes or chains (72) with loops (74) at each end are sufficiently short such that the cross-sectional member (20) is tensioned together so as to provide additional stabilization of the illuminated enclosure retrofit embodiment (3) in being mounted to a Jersey Barrier.

Another physical structure of the assistant attachment means (70) are physical structures for means for attaching flanges (50) that oppose one another that are engaged in a forklift fork cavity or gap between feet of a Jersey Barrier. One physical structure of this means for attaching flanges is a locking cable (52) with "T" end and a looped end which is threaded through opposing flanges (50) having holes. The "T" being too large to pass through the hole in a flange (50) and the looped end is threaded through the hole in the opposing flange (50) and blocked from passing back-out by the insertion of a shank of a padlock (54). Another physical structure of this means for attaching flanges is a rod with a hook at one end and an eye ring at the other end. The hooked end of the rod is slid through the forklift fork cavity or gap between feet of the Jersey Barrier, manipulated to engage the hole in a flange and the eye ring is attached to a flange having a hole using the shank of a padlock. The result being that theft of the illuminated enclosure retrofit embodiment (3) is deterred. Optionally, the locking cable (56) or rod is sufficiently short such that the flanges are tensioned together and thereby a cross-section member so as to provide additional stabilization of the illuminated enclosure retrofit embodiment (3) in being mounted to a Jersey Barrier.

The discussion now turns to installation and use of the illuminated enclosure retrofit embodiment (3). Referring to FIGS. 7A and 7B, an illuminated enclosure retrofit embodiment (3) has a shape reminiscent of a clamshell. This clamshell-like shaped structure fits over the narrow top of a Jersey Barrier. The illuminated enclosure retrofit embodiment (3) fits over the narrow top of the Jersey Barrier and is lowered down on the Jersey Barrier, until reaching the ground and any flanges (50) snap into place into forklift fork cavities or gaps between feet on the Jersey Barrier.

From time to time, a battery will need to be taken out of service for recharging or replaced. Changing the battery is accomplished in two ways. First, a battery can be replaced with a fresh battery through easily accessing the interior of an illuminated enclosure retrofit embodiment (3) via the slit (34) which runs the substantial vertical length of an end face (32) such that there are flaps (36) that can be pushed aside. The other way is by removing the tent-like covering (30) secured on one side of the assembly of a base (10) and a cross-sectional members (20) via undoing a means for fastening (14); e.g., a sliding a slit ring (17) off of a clevis pin (16). Thereafter, the tent-like covering (30) is pulled away so as to gain access to the volume inside the tent-like covering (30), including the battery box.

When no longer desired (e.g., the Jersey Barriers have served their purpose as a barricade and are being taken away) the illuminated enclosure retrofit embodiment (3) is easily removed as a complete assembly from the Jersey Barrier, except for the battery cradle (60). The lowest approximately horizontal elongated longitudinal members (12) of the base (10) on either side of the illuminated enclosure retrofit embodiment (3) is pulled away from the Jersey Barrier until the flanges (50) (teeth) on that side disengage from the bottom of the Jersey Barrier and that side is slightly lifted-up so that the flanges (50) cannot re-engage the forklift fork cavities or gap between feet of the Jersey Barrier. This process is repeated for the opposite side the illuminated enclosure retrofit embodiment (3). The illuminated enclosure retrofit embodiment (3) is then lifted off the Jersey Barrier. In the alternative, the tent-like covering (30) can first be unsecured from the assembly of a base (10) and cross-section members (20).

Figure 10A:
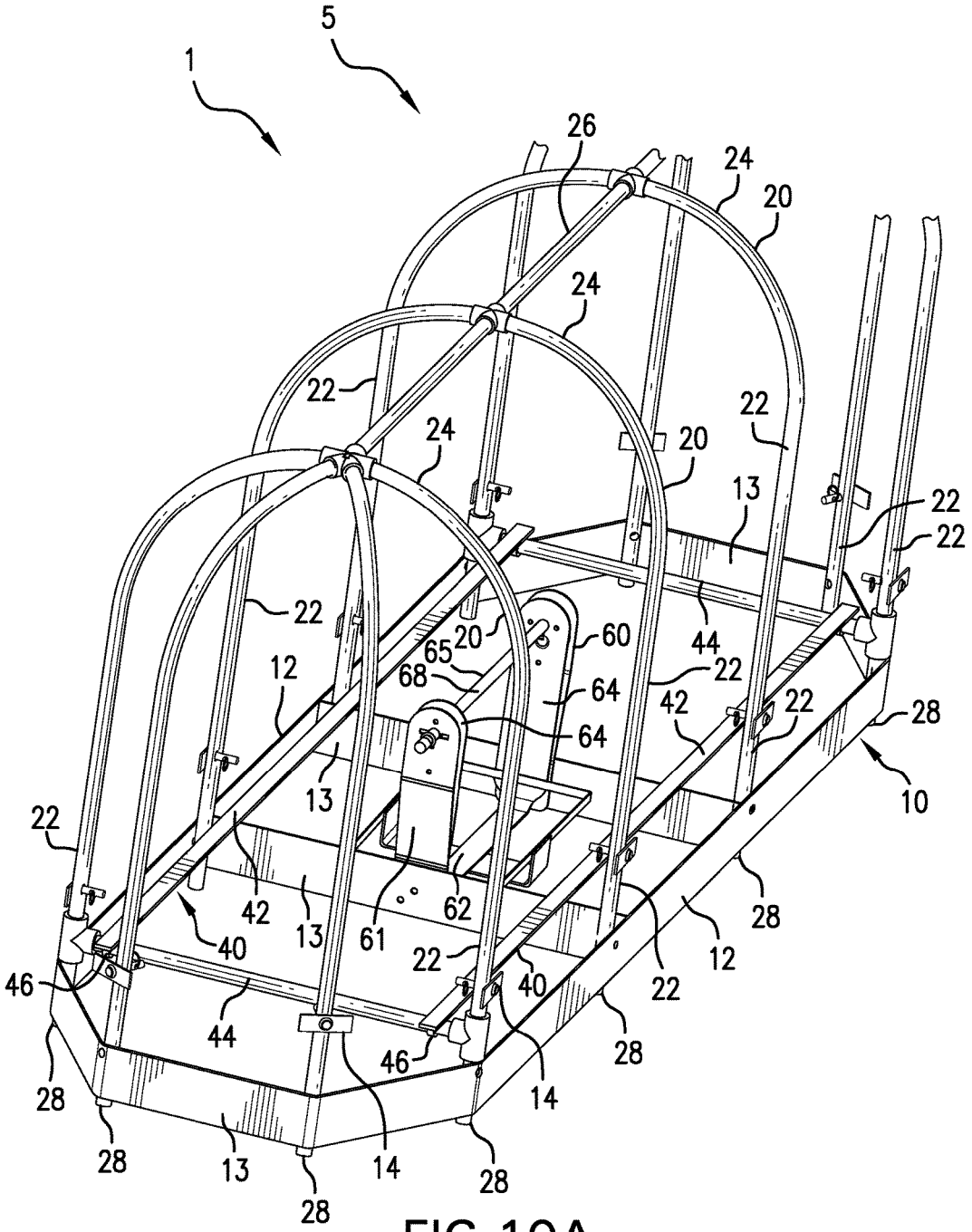
FIG. 10A shows a partial perspective view of a cutaway of the frame with a battery cradle of a standalone illuminated barrier embodiment according to the present invention.
Figure 11:
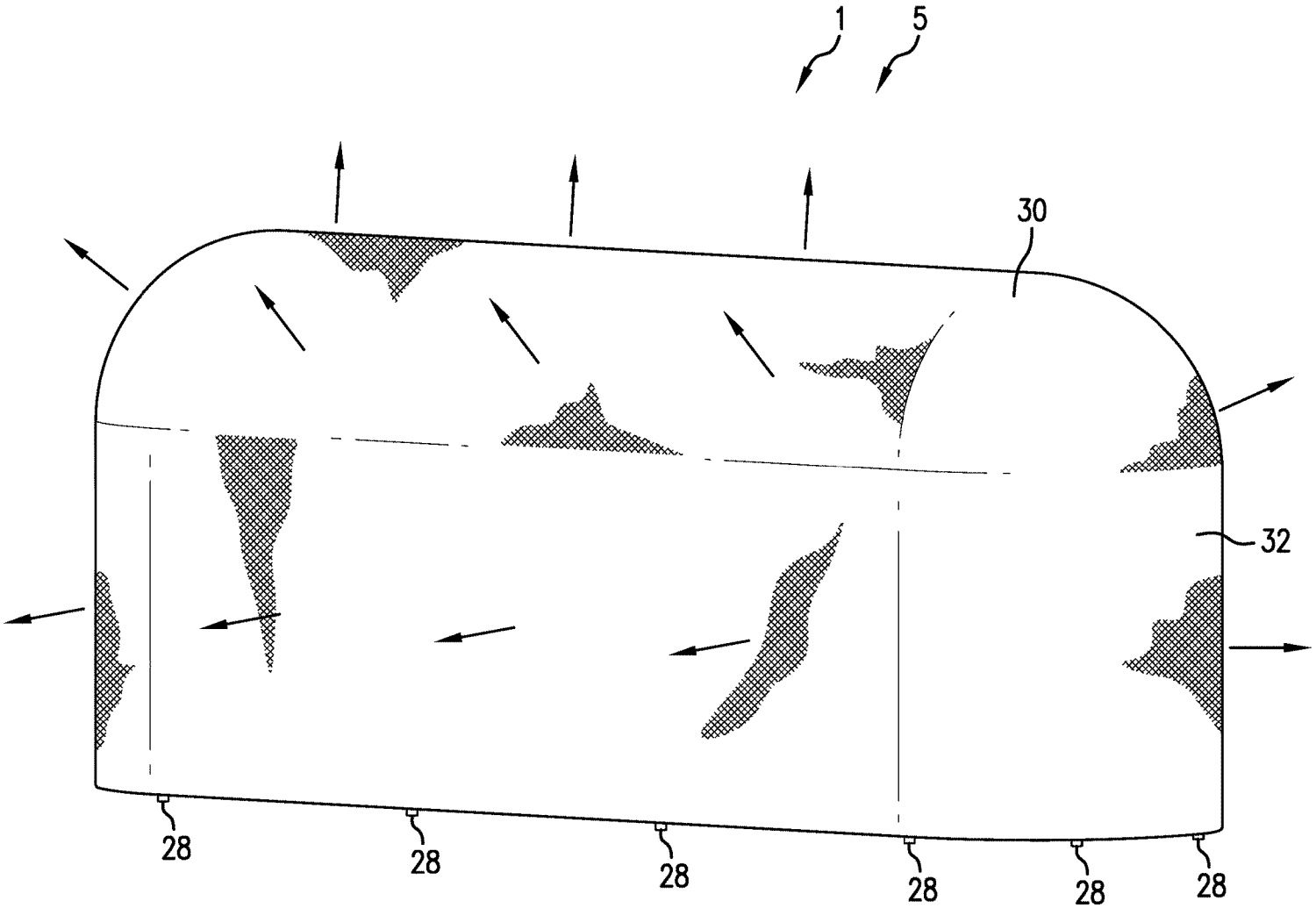
FIG. 11 shows an environmental perspective view of a standalone illuminated barrier embodiment according to the present invention in a state of use with arrows indicating illuminating light.

Referring to FIGS. 10A and 11, embodiments of this invention are adapted to be a standalone illuminated barrier embodiment (5). Like an illuminated enclosure retrofit embodiment (3), a standalone illuminated barrier embodiment (5) rests on the ground whereby the ground defines a frame of reference establishing a "lower," an "upper," a "horizontal" and a "vertical." Unless indicated otherwise, in significant part, the discussion above regarding to illuminated enclosure retrofit embodiment (3) applies to the standalone illuminated barrier embodiment (5) with the same effect and force as if that discussion were reprinted herein below.

Referring to FIG. 10A, there is a base (10) that is lower which is comprised of first approximately horizontal elongated longitudinal member (12); a second approximately horizontal elongated longitudinal member (12) that is approximately laterally opposing and spaced apart from the first approximately horizontal elongated longitudinal member (12) and having a substantial alignment with the first approximately horizontal elongated longitudinal member and at least one transverse member (13) spanning between the first and second approximately horizontal elongated longitudinal members (12). In embodiments of this invention, optionally and preferably, there is at least a second transverse member (13) spanning between the first and second approximately horizontal elongated longitudinal members (12). Preferably, there are transverse member (13) at the ends of the ends of the base (10). More preferably, the transverse member (13) has a half hexagonal or semicircular configuration. Most preferably, the transverse member (13) has a half hexagonal configuration. A transverse member (13) in the interior of the standalone illuminated barrier embodiment (5) preferably has a linear configuration.

Figure 12:
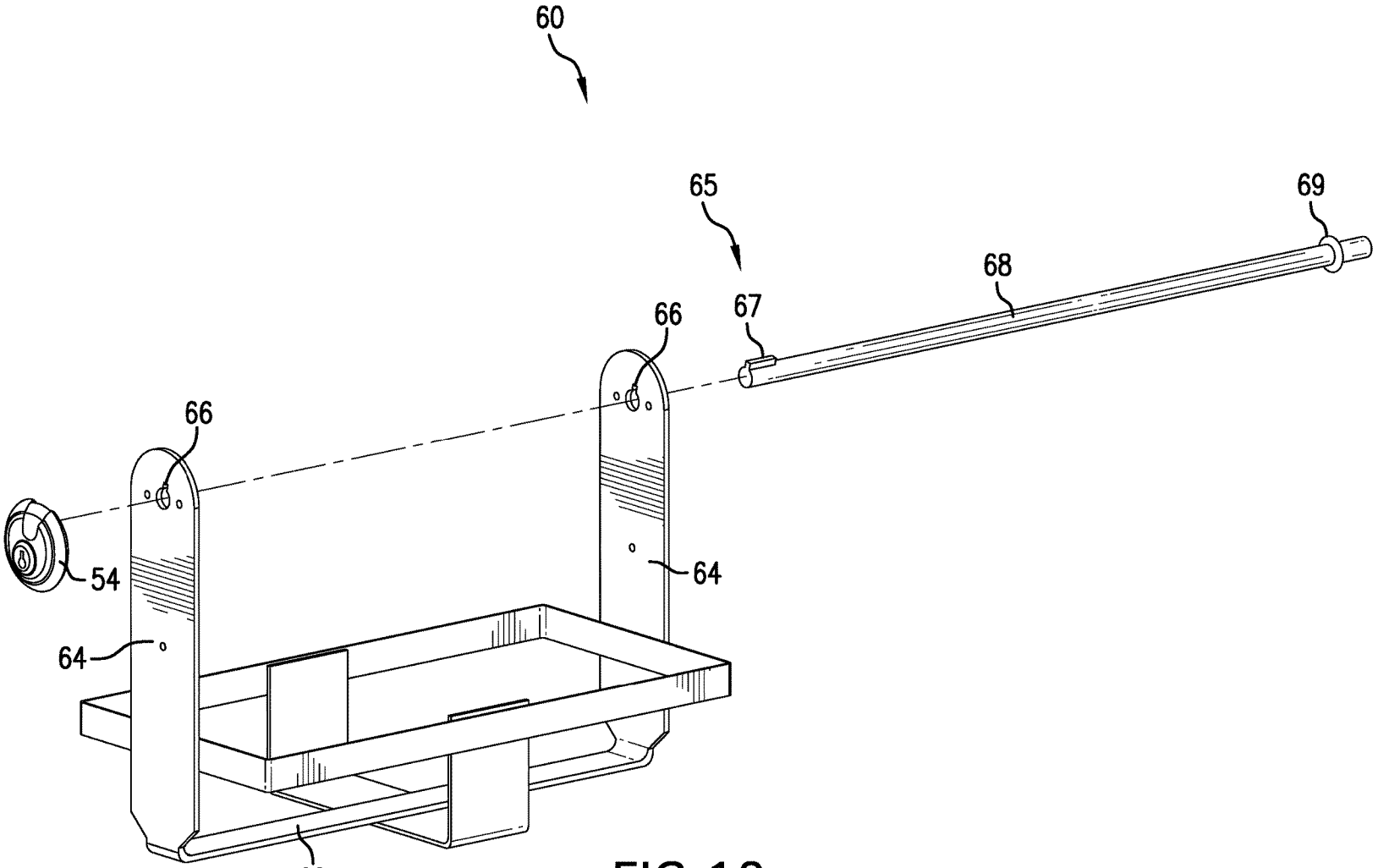
FIG. 12 shows an exploded perspective view of a battery cradle that rotatably mounts to support arms of a standalone illuminated barrier embodiment according to the present invention.
Figure 15A:
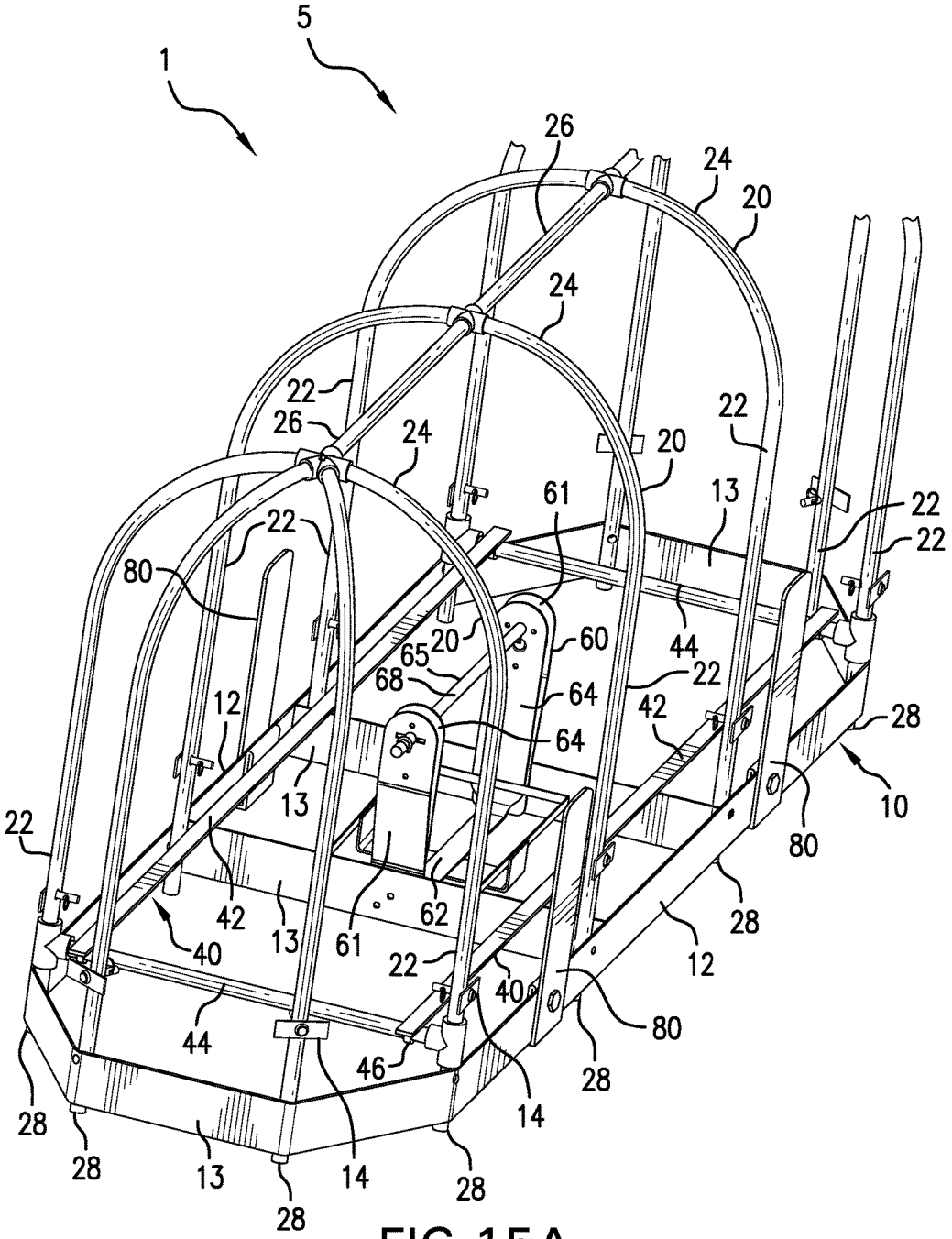
FIG. 15A (a modified version of FIG. 10A) shows a partial perspective view of a cutaway of the frame with a battery cradle of a standalone illuminated barrier embodiment according to the present invention with tipping paddles engaged to the approximately horizontal elongated longitudinal members.
Figure 15B:
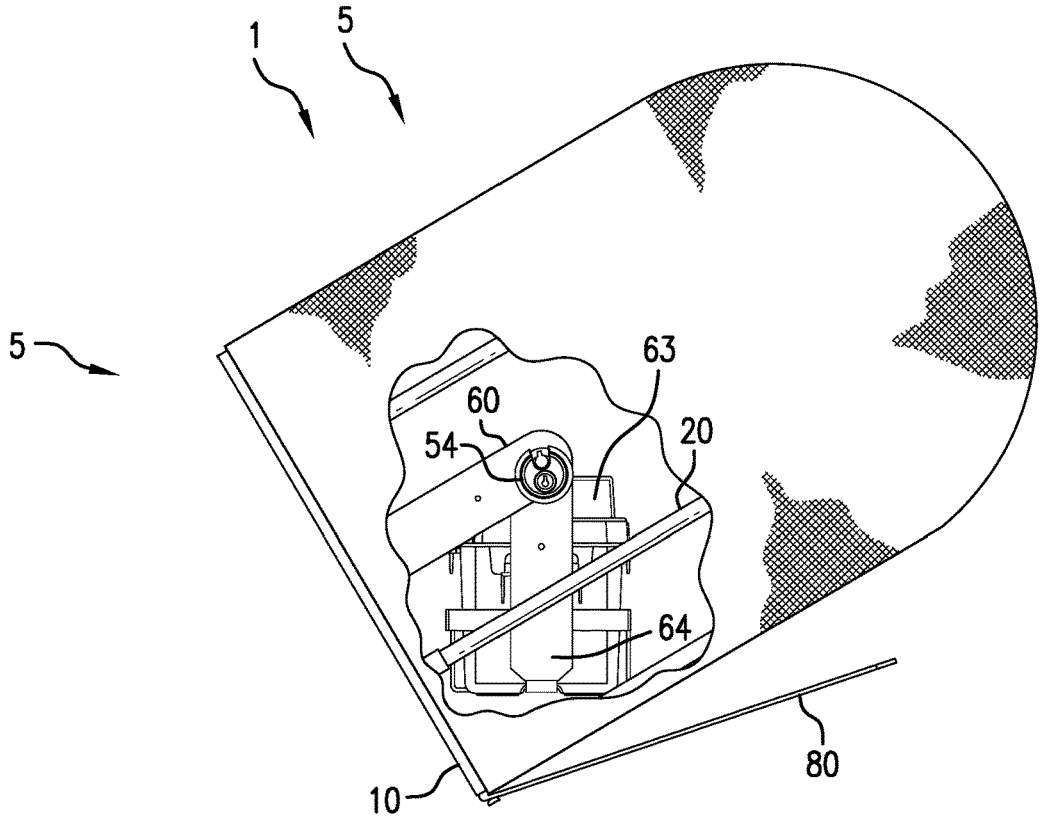
FIG. 15B shows a planar end view with a tent-like covering partially cut-away of a standalone illuminated barrier embodiment according to the present invention having a tipping paddle in a state of use of being tipped on its side.
Figure 15C:
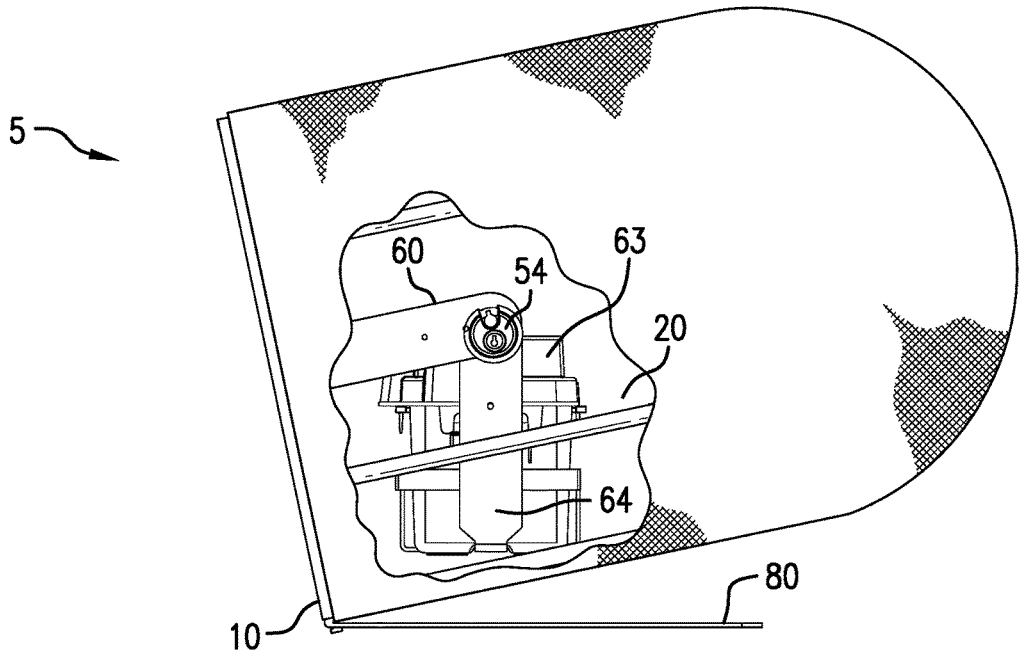
FIG. 15C shows a planar end view with a tent-like covering partially cut-away of a standalone illuminated barrier embodiment according to the present invention having a tipping paddle in state of use of having been tipped on its side and resting on the tipping paddle, thereby preventing the covering from contacting dirty and/or abrasive ground.

Referring to FIGS. 10A, 12 and 15A, there is battery cradle (60) for which the supports therefore are integral with the base (10). A pair of oppositely opposed support arms (61) upwardly append from a member (12, 13) of the base (10) and preferably upwardly append from spaced apart transverse members (13). More preferably, these oppositely opposed support arms (61) are positioned at about the center of the frame. The support arms (61) have a height slightly greater than the height of a battery box (63) to be disposed in the battery cradle (60). The support arms (61) have aligned keyed holes (66) to receive a keyed rod (68). In proximity to theses support arms (61), if not practically almost everywhere, the base (10) is open such that a battery can be passed through it. A battery box (63) as described above is rotatably mounted to the support arms (61). Referring to FIGS. 15A, 15B and 15C, when the standalone illuminated barrier embodiment (5) is rotated towards ground the battery cradle (60) and a battery or battery box (63) disposed within remains upright and accessible through the open base (10) (discussed further below.)

Referring to FIG. 12, optionally and preferably, there is a means for locking (15) a battery associated with the battery cradle (60). Physical structures for this means for locking (15) are a lid on the battery cradle (60) with a lock, a lockable belt that goes around a battery or a battery box that is attached to the battery cradle and a lockable in-place overhead keyed rod (68) that runs transverse across the upper of the battery cradle which restricts removing a battery or battery box (63), and all that which is within the battery box (63), as discussed above with respect to an illuminated enclosure retrofit embodiment (3). A lockable in-place overhead keyed rod (68) is preferred.

Referring to FIGS. 10A and 15A, there is a plurality of cross-sectional members (20) for which each spans crosswise between the first and second approximately horizontal elongated longitudinal members (12). The cross-sectional member (20) is comprised of a pair of approximately oppositely opposed vertical members (22) extending approximately upwards from the approximately horizontal elongated longitudinal members (12) and at least one roof member (24) spanning between the vertical members, almost all as discussed above with respect to an illuminated enclosure retrofit embodiment (3) with certain exceptions as discussed immediately below.

One exception is that unlike the roof member (24) in an illuminated enclosure retrofit embodiment (3), the roof member (24) in a standalone illuminated barrier embodiment (5) need not be flexible and resilient. That is, a standalone illuminated barrier embodiment (5) is not being expanded. Even so, for the purpose of manufacturing parts that are interchangeable between an illuminated enclosure retrofit embodiment (3) and a standalone illuminated barrier embodiment (5), preferably, the roof member (24) is flexible and resilient.

Referring to FIGS. 10A, 11, 15A and 16, another exception is that in alternative embodiments, the vertical members (22) extend below the first and second approximately horizontal elongated longitudinal members (12) so as to be "feet" (28) (stands) in contact with the ground on which this standalone illuminated barrier embodiment (5) rests. Another exception is in embodiments having a base (10) with a half hexagonal or semicircular end, there can be additional cross-sectional members where the vertical members (22) attach at a vertices of the half hexagonal end or at the intersection points of a secant running through the semicircular end. Commensurately, the roof member (24) is "V"-like.

Figure 13:
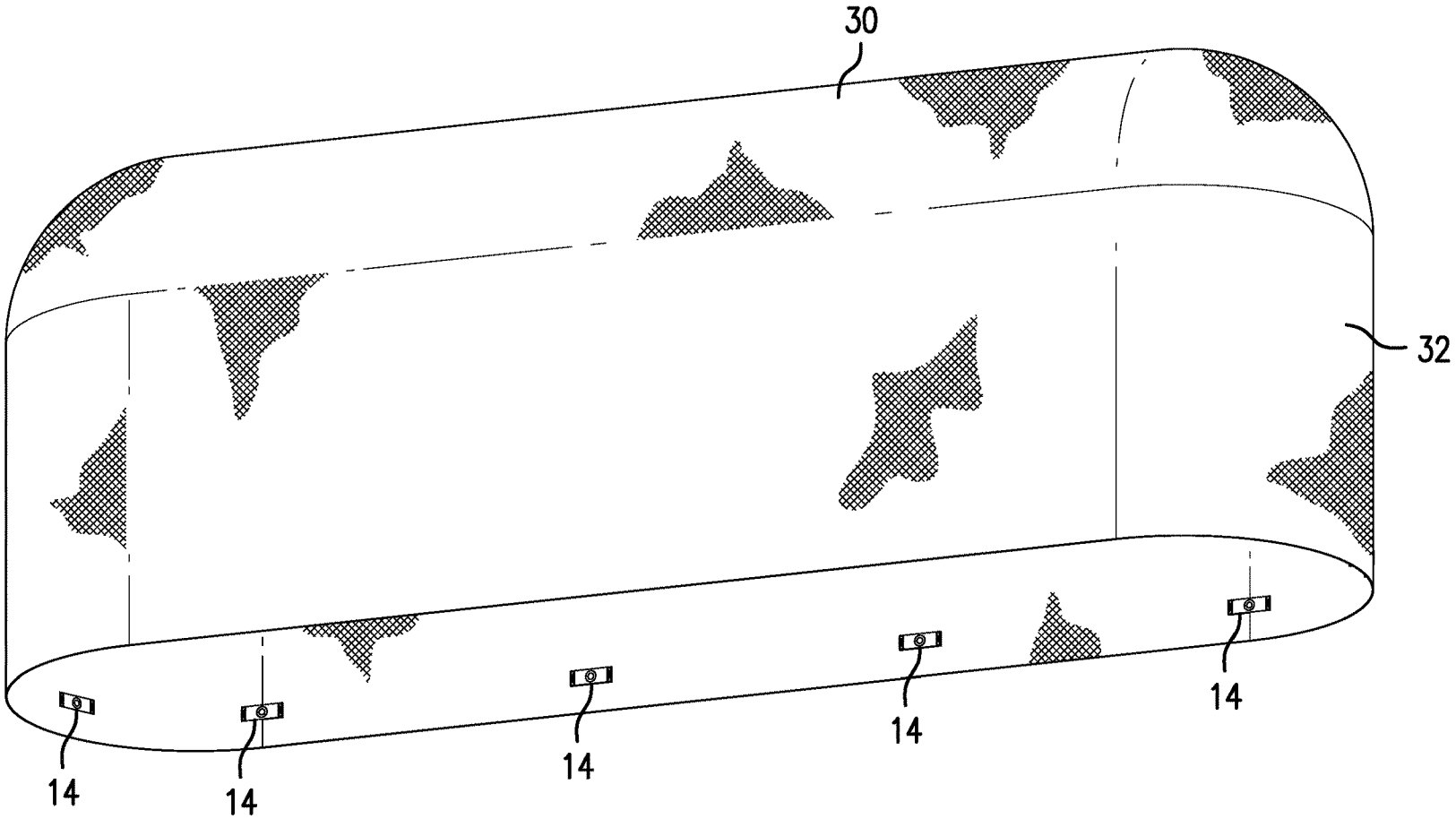
FIG. 13 shows a perspective view of the tent-like covering, with grommet tapes, which is received on the assembly of a base and cross-sectional members of a standalone illuminated barrier embodiment according to the present invention.
Figure 16:
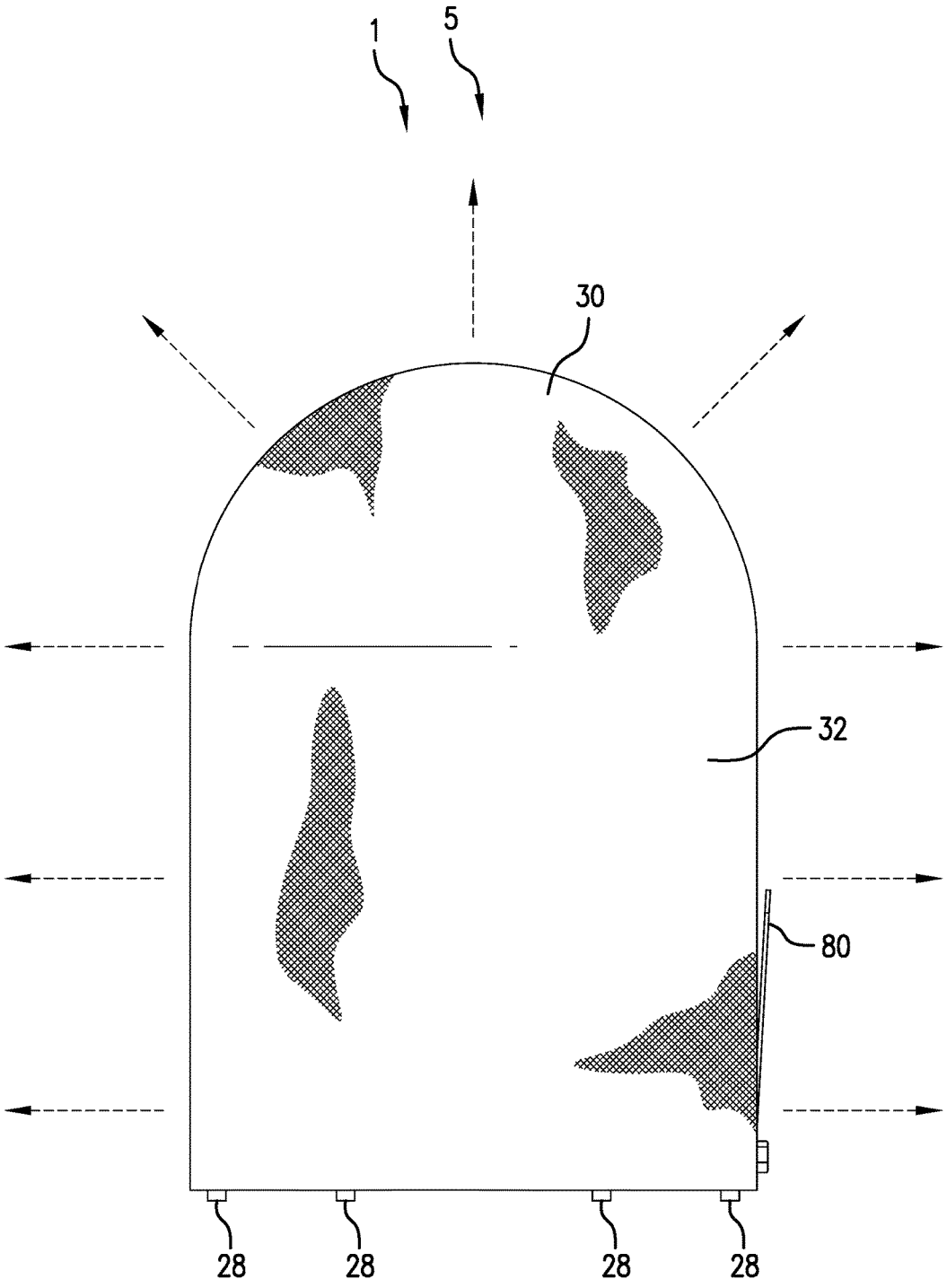
FIG. 16 shows a planar end view of a standalone illuminated barrier embodiment according to the present invention having a tipping paddle in a state of use and arrows indicating illuminated light.

Referring to FIGS. 11, 13 and 16, there is a tent-like covering (30) which is receivable on the assembly of the base (10) and the cross-sectional members (20), as discussed above with respect to an illuminated enclosure retrofit embodiment (3). Most preferably, the tent-like covering (30) is made out of an elastomeric and flexible material. As such, the tent-like covering (30) can be pulled away to create an opening for insertion of tipping paddles (80), discussed below.

Figure 14:
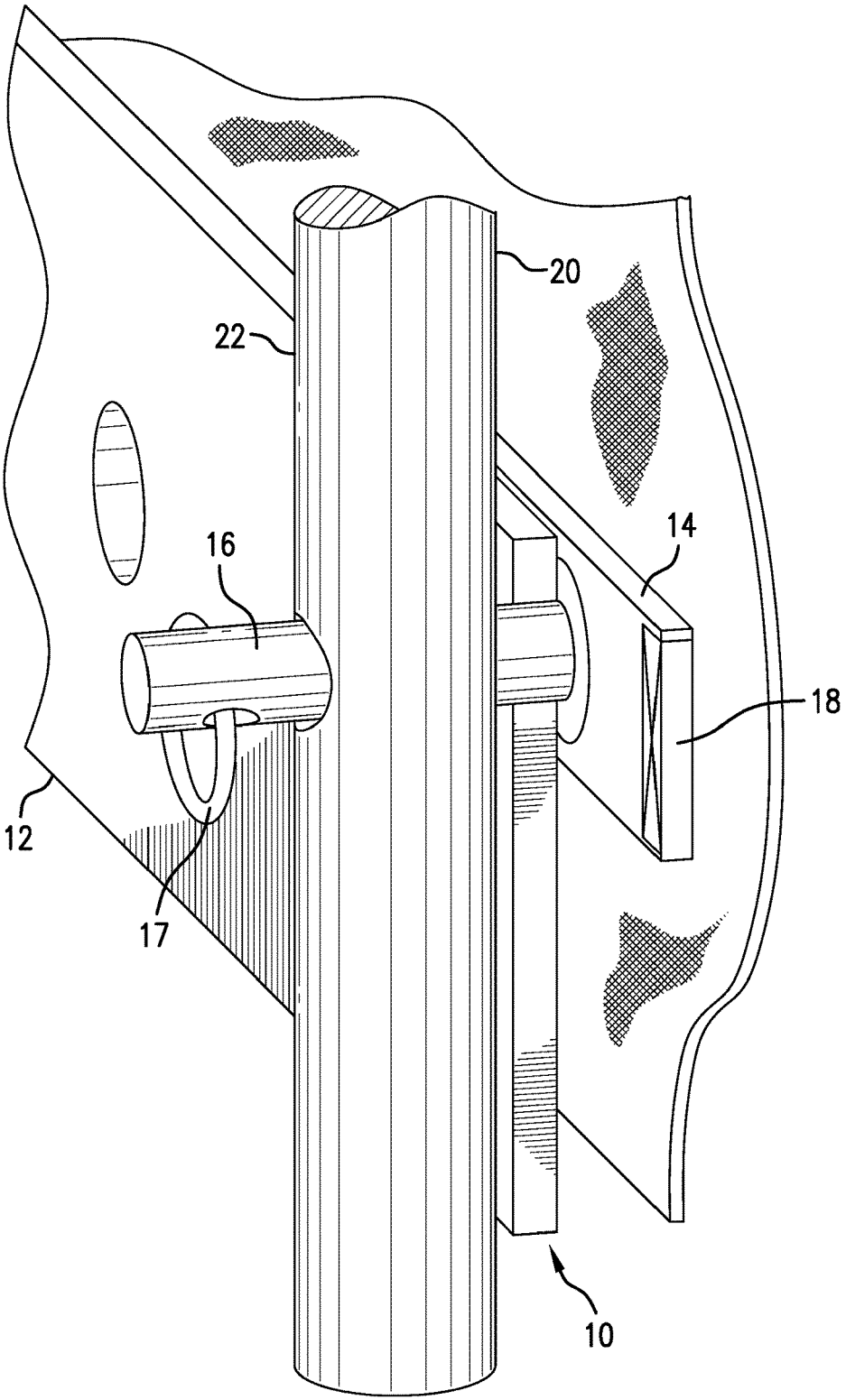
FIG. 14 shows a partial perspective view of a cutaway fragment of the frame of a standalone illuminated barrier embodiment according to the present invention featuring an approximately horizontal elongated longitudinal member, a vertical member and tent-like covering all secured together using a single quick-release fastener.

Referring to FIG. 14, as discussed above, there is a means for fastening (14) the tent-like covering (30) to the assembly of the base (10) and the cross-sectional members (20). Preferably, this means for fastening (14) is a quick-release fastener and more preferably, the quick-release fastener is an assembly of a clevis pin (14), split ring (16) and grommet tape (18). This means for fastening (14) can perform the dual function of securing the tent-like covering to assembly of the base (10) and the cross-sectional members (20) and also for attaching a vertical member (22) to an approximately horizontal elongated longitudinal member (12).

Figure 10B:
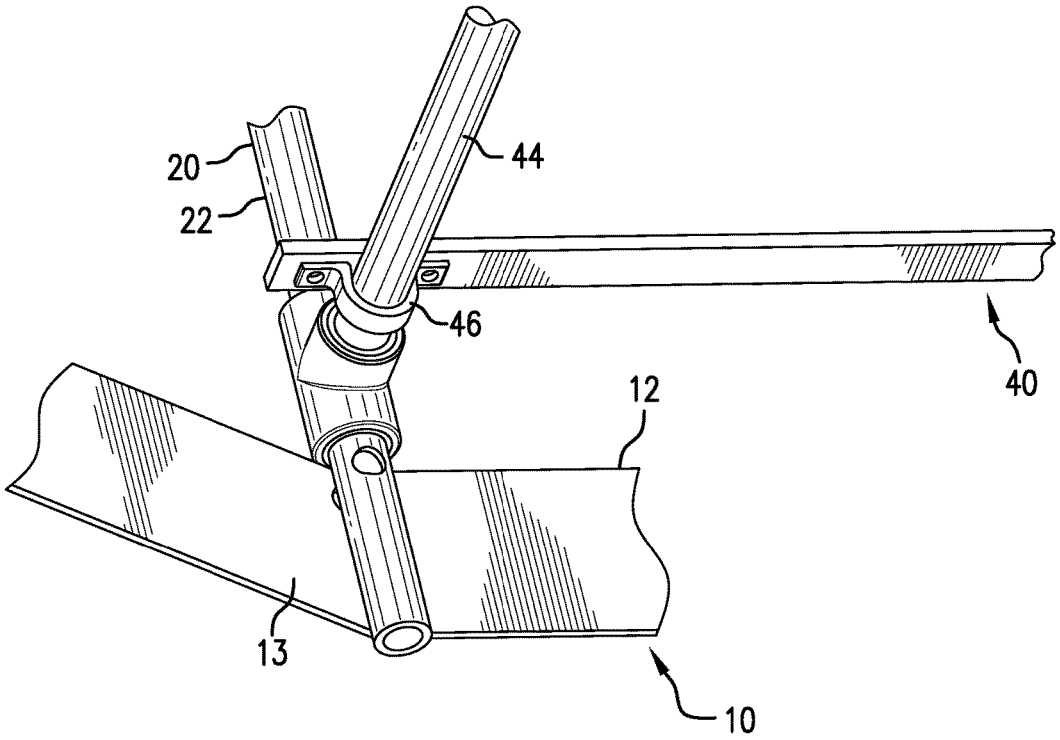
FIG. 10B shows a partial perspective view of a cutaway fragment of the frame of a standalone illuminated barrier embodiment according to the present invention featuring an approximately horizontal elongated longitudinal member, a transverse member, a vertical member and an LED lighting strip support member.

Referring to FIGS. 10A, 10B and 15A, there is a lighting system that is inner and coordinated to the assembly of the base (10) and the cross-section members (20) that substantially illuminates the tent-like covering (30), as discussed above with respect to an illuminated enclosure retrofit embodiment (3).

Referring to FIG. 9, optionally and preferably, there are one or more sensors in electrical communication with the wiring circuit for electrical communication, as discussed above with respect to an illuminated enclosure retrofit embodiment (3). Optionally and preferably, there is an electronic control means for controlling that which is on the wiring circuit for electrical communication and is in electrical communication with the wiring circuit for electrical communication, as discussed above with respect to an illuminated enclosure retrofit embodiment (3). Optionally and preferably, there is a subscriber identity module mobile telephony transmitter means for transmitting whereby there can be the capability of transmitting and receiving data, as discussed above with respect to an illuminated enclosure retrofit embodiment (3).

Referring to FIGS. 15 A, 15B, 15C and 16, to do maintenance on a battery on a standalone illuminated barrier embodiment (5) with its tent-like covering (30) secured to the assembly of a base (10) and plurality of cross-sectional members (20), the standalone illuminated barrier embodiment (5) is rotated on its side, as discussed below. During this rotation, the swinging style of the battery cradle (60) keeps upright the cradle, battery/battery box (63) and the contents with it.

Continuing to refer to FIGS. 15 A, 15B, 15C and 16, optionally and preferably, to accomplish the rotation there is at least one tipping paddle (80) that at times engages the base (10). The tipping paddle (80) has a lower section and an upper section. The lower section has a configuration resembling an "N" (with an extended vertical appendage coming off of the "V" of the right side of the end "N" referred to as the upper section). The inverted "V" of the left side of the "N" temporarily and slidingly engages an approximately horizontal elongated longitudinal member (12). The upper section is a linear length and functions as a resting support or easy grip lever, as discussed further below. Optionally, a tipping paddle (80) can be secured to an approximately horizontal elongated longitudinal member (12) by adding a fastener system. Preferably, the fastener system is a bolt and nut with corresponding holes in the tipping paddle (80) and approximately horizontal elongated longitudinal member (12).

Optionally, one or more tipping paddles (80) are temporarily engaged to the base (10) to act as an easy grip and lever to rotate the standalone illuminated barrier embodiment (5) towards ground. This tipping paddle (80) engages the base (10) along the first approximately horizontal elongated longitudinal members (12).

Typically, at least one tipping paddle (80) is temporarily engaged to the base (10) along the second approximately horizontal elongated longitudinal members (12) which impedes the tent-like covering (30) from contacting the ground when the standalone illuminated barrier embodiment (5) is rotated towards ground. The tipping paddle (80) itself contacts the ground, provides stability to the standalone illuminated barrier embodiment (5) while on its side, and keeps the side of the standalone illuminated barrier embodiment (5) off the ground. Preferably, there are two tipping paddles (80) that engage the base (10) along the second approximately horizontal elongated longitudinal members (12) so that the load of impeding the tent-like covering (30) from contacting the ground of the rotated standalone illuminated barrier embodiment (5) is distributed between the two tipping paddles (80). The result being that standalone illuminated barrier embodiment (5) is rotatable on its side without the tent-like covering contacting the ground so as to get damaged or dirtied.

The standalone illuminated barrier embodiment (5) is usable whenever and wherever crowds gather. The standalone illuminated barrier embodiment (5) is placed on the periphery of the crowds, wherever areas are to be delineated, and anywhere vehicles are not desired.

A version of the present invention is a method for using an illuminated barrier apparatus embodiment (1) comprised of the steps of: deploying an illuminated barrier apparatus embodiment (1); selecting out that illuminated barrier apparatus embodiment (1) where the tent-like covering is in a state for replacement; undoing the means for fastening (14) the tent-like covering (30) which is in a state for replacement from the assembly of the base (10) and the cross-section members (20); clearing the tent-like covering (30) which is in a state for replacement away from the assembly of the base (10) and the cross-section members (20) and fastening a replacement tent-like covering (30) to the assembly of the base (10) and the plurality of cross-section numbers (20).

The previously described versions of the present invention have many advantages. One advantage of an illuminated barrier apparatus is improved barrier visibility without adversely affecting the original functions of a barrier. Barriers that are more visible are safer. A related advantage is allowing drivers to better see warning signs which are printed/displayed on the illuminated barrier apparatus.

Another advantage is aesthetics. The illuminated barrier apparatus has a non-menacing appearance that is pleasant, attractive, and even welcomed. This "non-ugly" appearance mitigates a raised level of insecurity by a populace when barriers are placed about the populace. According to FEMA 430, a goal of perimeter security is to "expand the palette of elements that can gracefully or unobtrusively provide perimeter security in a manner that does not clutter the public realm, while avoiding the monotony of endless lines of jersey barriers or bollards which only evoke defensiveness."

Another advantage is adding light to an area surrounding the barrier and making that surrounding area more visible.

Another advantage is an automated system to report the location of an incident to first responders so as to reduce response times by first responders, as an incident's location is vitally important information required by all responders.

Another advantage is that the selling of advertising on the tent-like covering allays costs of the illuminated barrier apparatus.

EXAMPLES

The following examples further describe and demonstrate embodiments within the scope of the present invention. The examples are given solely for the purpose of illustration and are not to be construed as limitations or restrictions of the present invention, as persons skilled in the art will quickly realize many variations thereof are possible that are all within the spirit and scope of the invention.

Example 1

Example one is a prospective example of constructing a standalone illuminated barrier, along with a discussion of some of the technological challenges and features in doing so. The standalone illuminated barrier would be 36 inches tall plus 12 inches or minus 4 inches; 24 inches wide plus 12 inches or minus 6 inches and 6 to 8 feet long. A lower base frame would be made from strip steel. There would be two spaced apart and parallel lengths of strip steel as front and back. The ends of the base would be half-arcs to half-hexagons of strip steel or flat, as is the shape of the ends of the retrofit embodiment. The base frame is welded together. The standalone illuminated barrier has an open base at its bottom.

An upper frame with vertical poles and an arch roof would be made from lengths of polyvinyl chloride (PVC) pipe. For the rounded arch of the roof, the PVC would be heat formed. The lengths PVC tubing would be pieced together using connectors and held in place in the connectors using glue, although the tubing may press-fit/friction fit in place in a connector fitting. Alternatively, screws may also be used to a hold a PVC pipe end to a connector fitting to avoid permanently gluing the PVC pipe end to its connector fitting to permit disassembly/reassembly.

To attach the upper frame to the base, the vertical PVC poles could anchor into steel tubing sockets that are welded around the inside of the frame. Alternatively, the vertical PVC poles are attached to the base frame directly by filling a hole shared by the steel strip and PVC pole. The hole is filled with a clevis pin and locked with a split ring that secures through the hole at the end of the pin.

A tent cover fabric, which would be made out of a translucent fabric, glows when light is projected from within the tent. This tent cover is draped onto the upper frame. An arc of the tent cover, at the top, forms a round shape around the PVC frame, but the tent cover, at the bottom, where it meets the lower steel frame, cannot maintain the arc shape, wanting to be straight from one PVC support to the next. Consequently, this requires the lower frame to have the shape that the lower tent cover has. The tent cover fabric is stretchy so that it can be pulled back to provide access for tipping paddles.

A collection of 12 clevis pins, split rings and grommetted tape are used to secure the tent cover to the PVC poles. The same clevis pins and clevis rings which secure the tent cover to the PVC poles could also be used to hold the PVC tubes of the upper frame to the base. A segment of fabric with a grommet in the center (called "grommet tape") is to be sewn to the inside of the tent cover. The grommet tapes are positioned so as to be 2" from the ground. The clevis pin is inserted through the grommet, between the tent and grommet tape, through a hole drilled through the steel strip base and through a hole drilled through the PVC pole, and secured with a split ring. Because the split rings are small, they are hard for most persons to remove without a tool, much less having to remove all 12 that secure the tent cover to the poles, deterring theft.

There is needed a deep cycle battery capable of powering lighting for at least a few days, taking into account standard use of the lights coming on only when there is a low ambient light level. Such a battery is expensive and needs to be secured.

Because the tent cover is securely fastened to the PVC poles and in turn, fastened to the steel of the base frame, the only way to change the battery conveniently is through the bottom. To change the battery, then, would be difficult with stationary placement.

Turning the standalone illuminated barrier on its side offers access to the inside. Notwithstanding, turning the standalone illuminated barrier on its side would cause a precarious and unsafe condition due to the weight of the battery and an unshifting of the center of gravity. The standalone illuminated barrier would always want to sit flat on the ground and fight being on its side.

The solution is a sling type of battery cradle. The battery cradle is positioned at the center of gravity of the standalone illuminated barrier, holding a battery box, in the middle and just above the ground. Example 2 (below) illustrates constructing the battery cradle.

Tipping paddles are utilized to stabilize the standalone illuminated barrier while on its side to facilitate changing the battery, also preventing the covering from contacting the dirty and/or abrasive ground.

Example 2

Example two is a prospective example of constructing and using the battery cradle solution mentioned in Example 1 for securely housing and changing a battery in a stand-alone illuminated barrier. A pair of steel strips are drilled, cut and/or punched to have keyed holes at the same position near an end of the strip. These steel strips are secured to a base frame in a manner so as to be oppositely opposed vertical supports with the keyed holes in alignment. A rotatable sling is constructed by bending strip steel in a "U" shape. The central horizontal section is a support on which a battery box, into which a battery and circuit can be placed, sits. The two 90 degree bends establish sling arms which are drilled, cut or punched to have aligned keyed holes near their ends. A ½ inch diameter rod has a keyed end and an oversized end. The keyed end is inserted through the keyed hole of one of the vertical supports, through the keyed holes of the sling arms of the battery cradle and then the keyed hole of the other vertical support. A padlock is tightly positioned between the vertical support and the key of the rod so as to secure the rod against removal. Holes are drilled, cut, or punched into the vertical supports for temporary pins to maintain alignment while inserting or removing the keyed rod and to secure and prevent the sling from dropping away when the keyed rod is removed for accessing the battery box.

Two tipping paddles would be engaged to the base frame when inner access is needed. The paddles are positioned to be supports on which the side-tipped apparatus rests so that the apparatus's covering does not get dirtied or damaged by contacting the ground.

The battery box will sit in the cradle. The cradle is a swing so the battery box and its contents are always oriented upright. The shape of the tipping paddles acting as supports prevent the standalone illuminated barrier from rolling more than 90 degrees or retuning to upright without technician intent. Either upright or on a side, the center of gravity of the standalone illuminated barrier secures its position.

Temporary holding pins are inserted into the vertical support holes. The padlock with the shank fitted on the keyed rod between the key on the rod and the keyed hole of the vertical support is unlocked and the keyed rod is removed. The battery is changed, the key rod reinserted and locked in place, temporary holding pins are removed, the apparatus is righted, and tipping paddles are removed. The result being that the battery and circuitry in the battery box is well-secured against theft; the battery is fairly effortlessly accessed through the base of the side-tipped apparatus and the battery is fairly effortless changed for routine maintenance.

Example 3

Example three is a prospective example of a battery cradle for an illuminated enclosure retrofit. This battery cradle is designed to secure to the vertical wall portion of a Jersey Barrier and/or hang from the top shelf of a Jersey Barrier, resting against a sloped wall. The battery cradle would be constructed according to the following procedure. A primary steel strip is bent into a "U". Near the top ends of the two appendages of the "U", keyway slots that oppose each other and are able to accept a keyed rod are be drilled, cut, or punched into the strip. The keyway slot would have a profile of a circle with a rectangle centered at the top of the circle. A second steel strip would be welded perpendicular to the base of the primary "U" steel strip, then bends 90 degrees to extend vertically and taller than the height of the primary steel strip which then bends 96 degrees and thereafter 84 degrees to form an inverted "U" shaped hanger hook that fits onto the sloping, vertical wall portion of a Jersey Barrier. One or more holes could be drilled or punched through the vertical portion of this second steel strip to accept anchor bolts to further secure the cradle to the vertical wall portion of a Jersey Barrier with there being corresponding holes drilled into the Jersey Barrier to accept the anchor bolts. The secured battery box covers and limits access to the anchor bolts. There would be a third steel strip to go into the being formed battery cradle, welded to the vertical appendages of the primary "U" strip that horizontally wraps around like a belt having a rectangular profile with a perimeter slightly larger than the perimeter of a battery box, at that height. After placing a battery box into the formed battery cradle, a keyed rod with an oversized end at the opposite end to prevent it from going through the primary steel strip's keyways is inserted into the keyways and padlocked. The battery box and its contents will be supported by and secured to the Jersey Barrier by the battery cradle. The battery box or its cover cannot be removed or opened except by unlocking the padlock from the keyed rod, sliding the rod out, removing the battery box cover, and then taking the battery box or battery out in an upward direction.

Example 4

Example four is a prospective example of the lighting circuitry of an illuminated barrier apparatus. On the lighting circuitry there is placed a battery, at least two lighting strips with each of the lighting strips positioned so as to be disposed on each side of a Jersey Barrier's two sloping faces of its base (i.e., front and back) a low battery detector, an ambient light detector, a controller and a cellular telephone communicator. The ambient light detector determines when light is needed. The lighting would be off during daylight. As the intensity of the ambient light decreases, the intensity of the lights increases. When the battery is low so as to need charging or replacing, an alert is sent by the cellular telephone communicator. A motion detection and location system is installed having a gyroscope, an accelerometer and a global positioning system (GPS).

Although the present invention has been described in considerable detail with reference to certain preferred versions thereof, other versions are possible with substituted, varied and/or modified materials and steps are employed. For example, two side-by-side horizontal rectangular frames with transverse roof members not necessarily at the ends of the rectangular frame, but somewhere intermediate, would fall within the limitation of a cross-sectional members having approximately oppositely opposing vertical members and a roof member spanning therebetween. Offsetting the transverse member from directly in line with the opposing vertical members falls within the limitation of being approximately oppositely opposing vertical members. These other versions do not depart from the invention. Therefore, the spirit and scope of the appended claims should not be limited to the description of the preferred versions contained herein.

What is claimed is:

1. An illuminated barrier apparatus which directly or indirectly rests on the ground whereby the ground defines a frame of reference establishing a lower, an upper, a horizontal and a vertical where said apparatus is comprised of:

a a base that is lower which is comprised of:

i first approximately horizontal elongated longitudinal member and ii a second approximately horizontal elongated longitudinal member that is approximately laterally opposing and spaced apart from the first approximately horizontal elongated longitudinal member and having a substantial alignment with the first approximately horizontal elongated longitudinal member;

b a plurality of cross-sectional members for which each spans cross-wise between the first and second approximately horizontal elongated longitudinal members where each cross-sectional member is comprised of:

i a pair of approximately oppositely opposed vertical members extending approximately upwards from the approximately horizontal elongated longitudinal members and ii at least one roof member spanning between the vertical members, whereby the assembly of the base and the cross-sectional members have ends;

c a tent-like covering which is receivable on the assembly of the base and the cross-sectional members that:

i is substantially translucent;

ii substantially encloses the assembly of the base and the cross-section members and iii is fastened by way of a means for fastening to the assembly of the base and the cross-section members, whereby the enclosed volume defines an inner and an inwardly direction and d a lighting system that is inner and coordinated to the assembly of the base and the cross-section members that substantially illuminates the tent-like covering comprised of:

i one or more illumination means and ii a wiring circuit for electrical communication;

e adaptions selected from the groups consisting of:

i enclosure retrofit adaptions comprised of:

A adapting the roof member to have the property of being resilient and

B one or more flanges which extend inwardly from the assembly of the base and cross-sectional members at about the lowest level that are capable of following the profile of a Jersey Barrier as this illuminated barrier apparatus is mounted on a Jersey Barrier in a downward fashion and have a position so as to be capable of engaging a forklift fork cavity or gap between feet of a Jersey Barrier when this illuminated barrier apparatus is mounted on a Jersey Barrier, whereby the span of the cross-section members expand against the resilient force of the roof member as this illuminated barrier apparatus is mounted on a Jersey Barrier in downward fashion and the resilient force of the roof member urges the approximately horizontal elongated longitudinal members against the Jersey Barrier and urges the flange into the forklift fork cavity of the Jersey Barrier so as to provide stabilization of this illuminated barrier apparatus when mounted to a Jersey Barrier and ii standalone adaptions comprised of:

A the base also having at least one transverse members spanning between the first and second approximately horizontal elongated longitudinal members and an opening whereby a battery can be passed;

B a pair of oppositely opposed support arms upwardly appending from members of the base;

C a battery box cradle rotatably mounted to the support arms, whereby when this standalone illuminated barrier is rotated towards ground, components disposed in the cradle remain upright and the components being accessible through the opening.

2. The illuminated barrier apparatus of claim 1 where the retrofit adaptions are further comprised of a battery box cradle capable of receiving a battery box that is mountable to a Jersey Barrier and a means for locking a battery and associated circuitry associated with the battery cradle.

3. The illuminated barrier apparatus of claim 1 where the retrofit adaptions are further comprised of the tent-like covering having end faces with each end face having a substantially vertical slit running the substantial height of the end face with a means for closing in conjunction with the slit, whereby in a head-to-tail configuration of a multiplicity of Jersey Barriers with one end of this configuration defining a left and the other end defining a right, i on the Jersey Barrier at the left end of the head-to-tail configuration, the tent-like covering, that is receivable on the assembly of the base and the cross-sectional members, has the slit on the left end face closed and the slit on the other end face open;

ii on the one or more Jersey Barriers that are intermediate between the Jersey Barriers at the left and right ends of the head-to-tail configuration, the tent-like covering that is receivable on the assembly of the base and the cross-sectional members has the slits on each of the end faces open and iii on the Jersey Barrier at the right end of the head-to-tail configuration, the tent-like covering that is receivable on the assembly of the base and the cross-sectional members has the slit on the right end face closed and the slit on the other end face open, thereby, the tent-like covering is interoperable to be receivable on left end, intermediate and right end Jersey Barriers in a head-to-tail configuration of a multiplicity of Jersey Barriers.

4. The illuminated barrier apparatus of claim 1 where the standalone adaptions are further comprised of means for securing a battery box and its contents associated with the battery cradle.

5. The illuminated barrier apparatus of claim 1 where the standalone adaptions are further comprised of at least one tipping paddle that that is engaged to the base that impedes the tent-like covering from contacting the ground when the standalone illuminated barrier is rotated towards ground.

6. The illuminated barrier apparatus of claim 1 where the means for fastening is a quick release-like connector, whereby the tent-like covering can be replaced without significantly disturbing the remainder of the illuminated barrier apparatus.

7. An illuminated enclosure retrofit for a Jersey Barrier which rests on the ground whereby the ground defines a frame of reference establishing a lower, an upper, a horizontal and a vertical where said enclosure is comprised of:

a base that is lower which is comprised of:

i a first approximately horizontal elongated longitudinal member and ii a second approximately horizontal elongated longitudinal member that is approximately laterally opposing and spaced apart from the first approximately horizontal elongated longitudinal member and having a substantial alignment with the first approximately horizontal elongated longitudinal member;

b a plurality of cross-sectional members for which each spans cross-wise between the first and second approximately horizontal elongated longitudinal members where each cross-sectional member is comprised of:

i a pair of approximately oppositely opposed vertical members extending approximately upwards from the approximately horizontal elongated longitudinal members and ii at least one roof member spanning between the vertical members which is resilient, whereby the assembly of the base and the cross-sectional members has ends;

c a tent-like covering which is receivable on the assembly of the base and the cross-sectional members that:

i is substantially translucent;

ii substantially encloses the assembly of the base and the cross-section members and iii is fastened by way of a means for fastening to the assembly of the base and the cross-section members, whereby the enclosed volume defines an "inner" and an "inwardly" direction and d a lighting system that is inner and coordinated to the assembly of the base and the cross-section members that substantially illuminates the tent-like covering comprised of:

i one or more illumination means and ii a wiring circuit for electrical communication.

8. The illuminated enclosure retrofit of claim 7 where the roof member is arcuate.

9. The illuminated enclosure retrofit of claim 7 having one or more flanges for which each extends inwardly from approximately horizontal elongated longitudinal member at the lowest level which have the capability of following the profile of a Jersey Barrier as this illuminated enclosure retrofit is mounted on a Jersey Barrier in a downward fashion and have positions so as to be capable of engaging a forklift fork cavity or gap between feet of a Jersey Barrier when this illuminated enclosure retrofit is mounted on a Jersey Barrier, whereby the span of the cross-section members expand against the resilient force of the roof member as this illuminated enclosure retrofit is mounted on a Jersey Barrier in downward fashion and the resilient force of the roof member urges the approximately horizontal elongated longitudinal members against the Jersey Barrier and urges the flange into the forklift fork cavity of the Jersey Barrier so as to provide stabilization of this illuminated enclosure retrofit when mounted to a Jersey Barrier.

10. The illuminated enclosure retrofit of claim 7 having an assistant attachment means selected from the group consisting of:

a a means for attaching a pair of vertical members of a cross-section member to an eye hook on the end of a Jersey Barrier, whereby theft of this illuminated enclosure retrofit is deterred, and optionally, the cross-section members are tensioned together so as to provide stabilization of this illuminated enclosure retrofit when mounted to a Jersey Barrier and b a means for attaching flanges that oppose one another that are engaged in a forklift fork cavity of a Jersey Barrier, whereby the flanges are tensioned so as to provide stabilization of this illuminated barrier apparatus when mounted to a Jersey Barrier.

11. The illuminated enclosure retrofit of claim 7 having a battery cradle capable of receiving a battery box that is mountable to a Jersey Barrier and a means for locking a battery box and its contents associated with the battery cradle.

12. The illuminated enclosure retrofit of claim 7 where the tent-like covering has end faces with each end face having a substantial vertical slit running the substantial height of the end face with a means for closing in conjunction with the slit, whereby in a head-to-tail configuration of a multiplicity of Jersey Barriers with one end of this configuration defining a left and the other end defining a right, i on the Jersey Barrier at the left end of the head-to-tail configuration, the tent-like covering that is receivable on the assembly of the base and the cross-sectional members has the slit on the left end face closed and the slit on the other end face open;

ii on the one or more Jersey Barriers that are intermediate between the Jersey Barriers at the left and right ends of the head-to-tail configuration, the tent-like covering that is receivable on the assembly of the base and the cross-sectional members has the slits on each of the end faces open and iii on the Jersey Barrier at the right end of the head-to-tail configuration, the tent-like covering that is receivable on the assembly of the base and the cross-sectional members has the slit on the right end face closed and the slit on the other end face open, thereby, the tent-like covering is interoperable to be receivable on left end, intermediate and right end Jersey Barriers in a head-to-tail configuration of a multiplicity of Jersey Barriers.

13. The illuminated enclosure retrofit of claim 7 where the means for fastening is a quick release-like connector, whereby the tent-like covering can be replaced without removing the remainder of the illuminated enclosure retrofit form a Jersey Barrier on which it is mounted.

14. An illuminated enclosure retrofit for a Jersey Barrier which rests on the ground whereby the ground defines a frame of reference establishing a lower, an upper, a horizontal and a vertical where said enclosure is comprised of:

a a base that is lower which is comprised of:
- i first approximately horizontal elongated longitudinal member that is substantially linear and
- ii a second approximately horizontal elongated longitudinal member that is substantially linear, approximately laterally opposing and spaced apart from the first approximately horizontal elongated longitudinal member and having a substantial alignment with the first approximately horizontal elongated longitudinal member;

b a plurality of cross-sectional members for which each spans cross-wise between the first and second approximately horizontal elongated longitudinal members where each cross-sectional member is comprised of:
- i a pair of approximately oppositely opposed vertical members extending approximately upwards from the approximately horizontal elongated longitudinal members and
- ii an arcuate roof member spanning between the vertical members which is resilient, whereby the assembly of the base and the cross-sectional members has ends;

c one or more flanges for which each extends inwardly from an approximately horizontal elongated longitudinal member, is capable of following the profile of a Jersey Barrier as this illuminated enclosure retrofit is mounted on a Jersey Barrier in a downward fashion and is positioned so as to be capable of engaging a forklift fork cavity of a Jersey Barrier when this illuminated enclosure retrofit is mounted on a Jersey Barrier, whereby the span of the cross-section members expand against the resilient force of the roof member as this illuminated enclosure retrofit is mounted on a Jersey Barrier in downward fashion and the resilient force of the roof member urges the approximately horizontal elongated longitudinal members against the Jersey Barrier and urges the flange into the forklift fork cavity of the Jersey Barrier so as to provide stabilization of this illuminated enclosure retrofit when mounted to a Jersey Barrier;

d a tent-like covering which is receivable on the assembly of the base and the cross-sectional members that:
- i is substantially translucent-like;
- ii substantially encloses the assembly of the base and the cross-section members and
- iii is fastened by way of a means for fastening to the assembly of the base and the cross-section members, whereby the enclosed volume defines an "inner" and an "inwardly" direction and e a lighting system that is inner and coordinated to the assembly of the base and the cross-section members that substantially illuminates the tent-like covering comprised of:
- i one or more illumination means and
- ii a wiring circuit for electrical communication
- iii a battery cradle capable of receiving a battery box that is mountable to a Jersey Barrier and has a means for locking the battery box and its contents to the cradle.

15. The illuminated enclosure retrofit of claim 14 having an assistant attachment means selected from the group consisting of:

a a means for attaching a pair of vertical members of a cross-section member to an eye hook on the end of a Jersey Barrier, whereby theft of this illuminated enclosure retrofit is deterred and optionally, the cross-section members are tensioned together so as to provide stabilization of this illuminated enclosure retrofit when mounted to a Jersey Barrier and b a means for attaching flanges that oppose one another that are engaged in a forklift fork cavity of a Jersey Barrier, whereby the flanges are tensioned so as to provide stabilization of this illuminated barrier apparatus when mounted to a Jersey Barrier.

16. The illuminated enclosure retrofit of claim 14 where the battery cradle is comprised of a lower support, a first upwardly appending arm having a first keyed hole sized to conformingly receive a keyed rod having a first end that is oversized relative to the diameter of the keyed rod and a second end that is keyed, and a second upwardly appending arm with a second keyed hole that is sized to conformingly receive the keyed rod end where the first and second holes are positioned such that when a battery box is seated on the support, a keyed rod running through the keyed holes will buttress against the battery box, whereby a battery box and its contents can be locked for security against theft by seating the battery box on the lower support, running the keyed rod through the keyed holes with the end that is oversized relative to the diameter of the keyed rod in proximity to the first hole and the keyed end in proximity to the second hole and fixing a padlock conformingly around keyed rod between the keyed end and the second hole.

17. The illuminated enclosure retrofit of claim 14 having:

a one or more sensors in electrical communication with the wiring circuit for electrical communication selected from the group consisting of a low battery detector, ambient light detector, motion impact detector and global positioning satellite system receiver;

b an electronic control means for controlling that which is on the wiring circuit for electrical communication and is in electrical communication with the wiring circuit for electrical communication and c a subscriber identity module mobile telephony transmitter means for transmitting and receiving whereby there can be the capability of transmitting and receiving data.

18. A standalone illuminated barrier for resting on the ground whereby the ground defines a frame of reference establishing a lower, an upper, a horizontal and a vertical where said apparatus is comprised of:

a a base that is lower which is comprised of:
- i a first approximately horizontal elongated longitudinal member and
- ii a second approximately horizontal elongated longitudinal member that is approximately laterally opposing and spaced apart from the first approximately horizontal elongated longitudinal member and having a substantial alignment with the first approximately horizontal elongated longitudinal member;

iii at least one transverse member spanning between the first and second approximately horizontal elongated longitudinal members and iv a pair of oppositely opposed support arms upwardly appending from members of the base and v an opening whereby a battery can be passed;

b a battery cradle rotatably mounted to the support arms, whereby when this standalone illuminated barrier is rotated towards ground a battery box and its contents disposed in the cradle remains upright and the battery box and its contents being accessible through the opening;

c a plurality of cross-sectional members for which each spans cross-wise between the first and second approximately horizontal elongated longitudinal members where each cross-sectional member is comprised of:

i a pair of oppositely opposed of approximately oppositely opposed vertical members extending approximately upwards from the approximately horizontal elongated longitudinal members and ii at least one roof member spanning between the vertical members;

d a tent-like covering which is receivable on the assembly of the base and the cross-sectional members that is:

i substantially translucent;

ii substantially encloses the assembly of the base and the cross-section members and iii. fastened by way of a means for fastening to the assembly of the base and the cross-section members, whereby the enclosed volume defines an "inner" and an "inwardly" direction and e a lighting system that is inner and coordinated to the assembly of the base and the cross-section members that substantially illuminates the tent-like covering comprised of:

i one or more illumination means and ii a wiring circuit for electrical communication.

19. The standalone illuminated barrier of claim 18 comprised of an at least a second transverse member spanning between the first and second approximately horizontal elongated longitudinal members.

20. The standalone illuminated barrier of claim 18 where there is a means for locking a battery box and its contents associated with the battery cradle.

21. The standalone illuminated barrier of claim 20 where the battery cradle that is rotatably mounted to the support arms is further comprised of a first keyed hole in a support arm where the keyed hole is sized to conformingly receive a keyed rod having a first end that is oversized relative to the diameter of the keyed rod and a second end that is keyed and a second keyed hole in the other support arm where the keyed hole is sized to conformingly receive the keyed rod where the first and second holes are positioned such that when a battery box is seated in the cradle, a keyed rod running through the keyed holes will buttress against the battery box cover, whereby a battery can be locked for security against theft by seating the battery box in the cradle, seating the battery and associated circuitry in the battery box, running the keyed rod through the keyed holes with the end that is oversized relative to the diameter of the keyed rod in proximity to the first hole and the keyed end in proximity to the second hole and fixing a padlock conformingly around keyed rod between the keyed end and the second hole.

22. The standalone illuminated barrier of claim 18 where the means for fastening is a quick release-like connector, whereby the tent-like covering can be replaced without significantly disturbing the remainder of the standalone illuminated barrier.

23. The standalone illuminated barrier of claim 18 having:

a one or more sensors in electrical communication with the wiring circuit for electrical communication selected from the group consisting of a low battery detector, ambient light detector, motion impact detector and global positioning satellite system receiver;

b an electronic control means for controlling that which is on the wiring circuit for electrical communication and is in electrical communication with the wiring circuit for electrical communication and c a subscriber identity module mobile telephony transmitter means for transmitting and receiving whereby there can be the capability of transmitting and receiving data.

24. The standalone illuminated barrier of claim 18 having at least one tipping paddle that is engaged to the base that impedes the tent-like covering from contacting the ground when the standalone illuminated barrier is rotated towards ground.

25. A method for using the illuminated barrier apparatus of claim 1 comprised of the steps of:

(a) Deploying the illuminated barrier apparatus;

(b) Selecting out the illuminated barrier apparatus claim 1 where the tent-like covering is in a state for replacement;

(c) undoing the means for fastening the tent-like covering which is in a state for replacement from the assembly of the base and the cross-section members;

(d) clearing the tent-like covering which is in a state for replacement away from the assembly of the base and the cross-section members and (e) fastening a replacement tent-like covering to the assembly of the base and the plurality of cross-section numbers.

* * * * *